US007532828B2

(12) United States Patent
Komiya et al.

(10) Patent No.: US 7,532,828 B2
(45) Date of Patent: May 12, 2009

(54) IMAGE FORMING APPARATUS AND DEVELOPER REMAINING AMOUNT DETECTING METHOD

(75) Inventors: Nobuo Komiya, Yokohama (JP); Takayuki Namiki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 235 days.

(21) Appl. No.: 11/680,060

(22) Filed: Feb. 28, 2007

(65) Prior Publication Data

US 2007/0206966 A1 Sep. 6, 2007

(30) Foreign Application Priority Data

Mar. 1, 2006 (JP) ..... 2006-055610

(51) Int. Cl.
*G03G 15/08* (2006.01)

(52) U.S. Cl. ..... 399/27; 399/111; 399/119; 399/120

(58) Field of Classification Search ..... 399/9, 399/24, 25, 27, 107, 111, 119, 120
See application file for complete search history.

(56) References Cited

U.S. PATENT DOCUMENTS

| | | | | |
|---|---|---|---|---|
| 5,987,269 | A | 11/1999 | Allen et al. | 399/27 |
| 6,377,759 | B1 * | 4/2002 | Abe et al. | 399/27 |
| 6,415,112 | B1 | 7/2002 | Kimizuka et al. | 399/27 |
| 6,591,070 | B1 | 7/2003 | Shoji et al. | 399/27 |
| 6,859,627 | B2 * | 2/2005 | Karakama et al. | 399/27 |
| 2007/0206966 | A1 | 9/2007 | Komiyama et al. | 399/27 |

FOREIGN PATENT DOCUMENTS

| | | |
|---|---|---|
| JP | 61-176962 | 8/1986 |
| JP | 7-325473 | 12/1995 |
| JP | 2001-134064 | 5/2001 |
| JP | 2000-206774 | 9/2001 |
| JP | 2002-268362 | 9/2002 |

* cited by examiner

*Primary Examiner*—Hoan H Tran
(74) *Attorney, Agent, or Firm*—Fitzpatrick, Cella, Harper & Scinto

(57) ABSTRACT

An image forming apparatus, which uses a developing device including: a developer carrying member; a developer containing portion; an agitating member agitating a developer; a developer amount detecting member outputting a signal for detecting the remaining amount of the developer contained in the developer containing portion, the image forming apparatus including a main body controller detecting the remaining amount using a first detecting unit that sets a reference value as a reference for detecting the remaining amount by the signal, and thereafter calculates the remaining amount based on an amount of change in the signal from the reference value, and a second detecting unit that detects the remaining amount based on a band of fluctuation in the signal corresponding to a rotational period of the agitating member.

38 Claims, 28 Drawing Sheets

IMAGE FORMING APPARATUS AND DEVELOPER REMAINING AMOUNT DETECTING METHOD

BACKGROUND OF THE INVENTION

1. Field of the Invention

The present invention relates to an image forming apparatus, particularly with a detachably mountable cartridge of an electrophotographic system such as a laser beam printer, a copying machine, a facsimile, or a multi-function printer in a combination of these. Further, the present invention relates to a method of detecting the remaining amount of developer contained in a developing device that develops an electrostatic latent image formed on an electrophotographic photosensitive member through such image forming apparatus.

2. Description of the Related Art

An image forming apparatus for forming an image based on an image signal sent from a host computer includes an electrophotographic system, an inkjet system, a thermal sensitive system, and other various systems. Among these, the image forming apparatus of electrophotographic system is becoming increasingly widespread in recent years in terms of high-speed, high image quality, and high degree of silence and other advantages.

<Regarding Process Cartridge>

Since each of components of the image forming apparatus of electrophotographic system wears and is abraded or becomes exhausted each time an image formation is executed, maintenance will be needed after a fixed amount of image formations have been executed. In particular, since a toner is consumed by the image formation, the need for replacement arises.

As a consequence, in order to replace these consumables as easily as possible, there is a system configured for a photosensitive drum unit and a toner cartridge to be replaceable independently. In addition, a process cartridge system may be adopted in some cases, in which a photosensitive drum, a charging roller, a developing device, and a cleaning blade are integrated compactly.

The former is mainly used for a copying machine or the like; when a photosensitive drum reaches its lifetime, only a photosensitive drum unit is replaced; when a toner is totally consumed, only a toner cartridge is replaced. Each lifetime is alerted to a user by issuing a warning, for example, on a display panel of the image forming apparatus by means of each lifetime detecting unit. With this method, a photosensitive drum, toner can be independently replaced, and thus it is economical. When replacing a toner cartridge, however, it is necessary for a user to do work carefully so as not to touch the toner.

On the other hand, in the latter process cartridge system, when toner is totally consumed, it is replaced together with a process cartridge. As a result, it has a merit of easy-to-handle. Further, maintenance of the apparatus can be performed by users per se without relying on servicepersons, and consequently the operability can be substantially enhanced. In recent years, widespread use centering around a small-sized image forming apparatus including a laser beam printer is being achieved.

In such a process cartridge, in order to prevent a poor image due to the exhaustion of toner, some units often detect information on the remaining amount of toner, and send a notice of the result to the image forming apparatus or a host computer to which the apparatus is connected, and then alert to users.

<Regarding the Detection of Remaining Amount of Toner>

There are various systems as a detecting unit for the remaining amount of toner. For example, there are proposed a method of detecting plural levels of the remaining amounts of toner by means of piezoelectric elements or photocouplers (Refer to Japanese Patent Application Laid-Open No. 61-176962), and a method of detecting successively the amounts of toner by measuring capacitances between metal plate-shaped electrodes (U.S. Pat. No. 5,987,269).

Further, there is proposed a method of successively detecting the amount of toner by measuring capacitances between a metal plate-shaped electrode member disposed within the image forming apparatus or within the process cartridge, and a developing member serving as a developer carrying member for conveying toner to a developing portion on a photosensitive member (Refer to Japanese Patent Application Laid-Open No. 2000-206774).

In addition to above, there are an optical system for detecting the amount of light that passes through the interior of a toner container containing toner, and a pixel signal totalizing system in which individual image signals forming dots are counted, and the amount of consumption of toner is determined by multiplying the number of counts with a predetermined coefficient.

The amount of toner detected by such a developer remaining amount detecting device is indicated on an indicating unit so that users can recognize. This recognition by users enables more efficient printing work and effective use of the process cartridge.

Among the above methods, a method of detecting the remaining amount of toner by measuring capacitances between electrode members is widely used for the process cartridge because added circuit is relatively simple, and a high accuracy can be achieved.

In a method of measuring capacitances between the above-mentioned electrode members, a metal plate (electrode metal plate at output side), for example, serving as an electrode member at output side is provided at a spot opposite to the developing member, and a metal plate (electrode metal plate at input side) serving as an electrode member at input side is provided at a spot opposite to an electrode metal plate at output side. And, each of the electrode metal plate at output side, the electrode metal plate at input side, the developing member acting as the electrode member at input side is used as an electrode for a capacitor, taking an advantage of variation of the capacitance between respective electrode members corresponding to the amount of toner.

In other words, when a space (this equates to capacitor) configured by metal plates (the electrode metal plate at output side, the electrode metal plate at input side) and the developing member is filled with toner, capacitance becomes large, whilst air within the above space increases and capacitance becomes small as the amount of toner decreases. The remaining amount of toner is detected by utilizing the variations of these capacitances.

If the sizes, areas of metal plates as electrode members, or distances between the metal plates are different, detected capacitance values introduce variations reflecting these individual differences. If the metal plates are provided within the process cartridge, it is difficult to avoid introducing individual differences in the distance between the metal plate and the developing member, the distance between metal plates, and the size of metal plates from a manufacture viewpoint. For this reason, if the remaining amount of toner is detected using a relationship that has been set in advance between a specific capacitance and the remaining amount of toner, it is difficult to detect accurate amount of the remaining toner in conformity with respective process cartridges due to individual differences like the above.

For this reason, the following methods are proposed in order to perform accurate toner remaining amount detection in conformity with respective process cartridges regardless of individual differences like the above.

More specifically, a method of storing an output value when a maximum amount of toner, i.e. a maximum capacitance is detected by a developer remaining amount detecting unit, and detecting the remaining amount of toner based on its reference value (Refer to Japanese Patent Application Laid-Open No. 2001-134064) is proposed.

Further, there is proposed a method of setting a threshold value for an output value as a reference value on a storage medium when a maximum amount of toner, i.e. a maximum capacitance is detected by the developer remaining amount detecting unit, and coping with a deviation of the output value serving as a reference (Refer to Japanese Patent Application Laid-Open No. 2002-268362).

A method of setting a detected value corresponding to a maximum capacitance value as a reference value as described above, detecting an amount of change between the reference value and an output value at this time point, and estimating the remaining amount of toner is used widely because of high accuracy and less-complex processing.

However, a conventional method of detecting the remaining amount of toner by measuring capacitances between electrode members, as described above, has the following problems.

In other words, in the case where an use environment of the process cartridge changes, or in the case where a toner condition changes accompanied by a long-term use, capacitance values detected by the developer remaining amount detecting unit have fluctuated during use of the process cartridge. Therefore, there was a limit in measuring accurately the remaining amount of toner.

For example, water has a higher relative permittivity than air, and thus the more water is present between electrode members, the larger capacitance is detected. Hence, a larger capacitance is detected under a high humidity environment than under a low humidity environment, and the accuracy in detecting the remaining amount of toner becomes worse if use environment of the process cartridge extends over both high humidity and low humidity. In particular, if there is a difference between an environment under which the amount of toner that determines a reference value is detected at maximum, and an environment under which the remaining amount of toner becomes small, a detection error becomes large.

Also, this is the same with the case where the condition of toner has changed. For example, if a printing ratio at which users perform printing is extremely low, there is a possibility that the use of the process cartridge extends over a longer period, and toner gets deteriorated. Deteriorated toner tends to have a larger density compared with fresh toner, and in this case, even for a toner with the same volume, its capacitance value will become small due to its low density.

Also, detected capacitance value fluctuates even with adherence of some amount of toner to an electrode metal plate. The amount of toner that has adhered to the electrode metal plate varies depending on each cartridge, depending on each condition in which it has been used. The more the amount of toner has adhered, the more measured capacitances are detected than actual amount of toner.

As described above, there was a possibility that the accuracy in detecting the remaining amount of toner becomes worse due to various factors.

In an apparatus that makes an erroneous detection in which detected amount of toner tends to be smaller than an actual amount of toner, the followings are considered.

For example, a user probably replaces a process cartridge with new one according to indicated remaining amount of toner that is related to the output value of the developer remaining amount detecting unit, in spite of some toner remaining in reality. This is undesired from viewpoint of effective utilization of resources too.

Also, on the contrary, in an apparatus that makes an erroneous detection in which detected amount of toner tends to be larger than an actual amount of toner, for example, toner is totally exhausted during printing operation, a poor image develops, and recording sheets are used in waste.

SUMMARY OF THE INVENTION

It is accordingly an object of the present invention to provide an image forming apparatus that enables to improve the accuracy in detecting a remaining amount of a developer within a developer containing portion of a developing device, and to provide a method of detecting the remaining amount of a developer.

Also, another object of the present invention is to provide an image forming apparatus using a developing device having a developer carrying member that develops an electrostatic latent image formed on an electrophotographic photosensitive member using the developer; a developer containing portion that contains the developer; an agitating member provided rotatably in the developer containing portion to agitate the developer; and a developer amount detecting member that outputs a signal for detecting the remaining amount of the developer contained in the developer containing portion, the image forming apparatus having: a main body controller to which a signal is input to detect the remaining amount of a developer, the main body controller performing a detection of the remaining amount using a first detecting unit that sets a reference value serving as a reference for detecting the remaining amount by a signal, and subsequently calculates the remaining amount based on an amount of change in the signal from the reference value, and a second detecting unit that detects the remaining amount based on a band of fluctuation in the signal corresponding to a rotational period of the agitating member.

Also, a further object of the present invention is to provide an image forming apparatus using a developing device having a developer carrying member that develops an electrostatic latent image formed on an electrophotographic photosensitive member using a developer, a developer containing portion that contains the developer, an agitating member provided rotatably in the developer containing portion to agitate the developer, and a developer amount detecting member that outputs a signal for detecting the remaining amount of the developer contained in the developer containing portion, the image forming apparatus having: a main body controller to which a signal is input to detect the remaining amount of the developer, the main body controller having a reference value setting unit that sets a reference value serving as a reference for detecting the remaining amount of the developer by the signal, a remaining amount detecting unit that calculates the remaining amount of the developer based on an amount of change in the signal from the reference value, a band of fluctuation detecting unit that detects a band of fluctuation in the signal corresponding to a rotational period of the agitating member, and a reference value changing unit that changes the reference value to a new reference value derived from the band of fluctuation.

Also, still another object of the present invention is to provide an image forming apparatus using a developing device having a developer carrying member that develops an electrostatic latent image formed on an electrophotographic photosensitive member using a developer, a developer containing portion that contains the developer, an agitating member provided rotatably in the developer containing portion to agitate the developer, and a developer amount detecting member that outputs a signal for detecting the remaining amount of the developer contained in the developer containing portion, the image forming apparatus having: a main body controller to which the signal is input to detect the remaining amount of the developer, the main body controller having a reference value setting unit that sets a reference value serving as a reference for detecting the remaining amount of the developer by the signal, a remaining amount detecting unit that calculates the remaining amount of the developer based on an amount of change in the signal from the reference value, a band of fluctuation detecting unit that detects a band of fluctuation in the signal corresponding to a rotational period of the agitating member, and a correcting unit that corrects the remaining amount of the developer calculated by the remaining amount detecting unit on the basis of a corrected value derived from a band of fluctuation.

Also, a still further object of the present invention is to provide a method of detecting a remaining amount of a developer contained in a developer containing portion, in an image forming apparatus using a developing device having a developer carrying member that develops an electrostatic latent image formed on an electrophotographic photosensitive member using a developer, a developer containing portion that contains the developer, an agitating member provided rotatably in the developer containing portion to agitate the developer, and a developer amount detecting member that outputs a signal for detecting the remaining amount of the developer contained in the developer containing portion, the detecting method having: a first step of setting a reference value serving as a reference for detecting the remaining amount by the signal, and subsequently calculating the remaining amount based on an amount of change in the signal from the reference value, and a second step of detecting the remaining amount based on a band of fluctuation in the signal corresponding to a rotational period of the agitating member.

Also, a still further object of the present invention is to provide a method of detecting a remaining amount of a developer contained in a developer containing portion, in an image forming apparatus using a developing device having a developer carrying member that develops an electrostatic latent image formed on an electrophotographic photosensitive member using the developer; a developer containing portion containing the developer; an agitating member provided rotatably in the developer containing portion to agitate the developer; and a developer amount detecting member that outputs a signal for detecting a remaining amount of the developer contained in the developer containing portion, the detecting method having: a reference value setting step of setting a reference value to be a reference for detecting a remaining amount of the developer by the signal; a remaining amount detecting step of calculating a remaining amount of the developer based on an amount of change in the signal from the reference value; a band of fluctuation detecting step of detecting a band of fluctuation in the signal corresponding to a rotational period of the agitating member; and a reference value changing step of changing the reference value to a new reference value derived from the band of fluctuation.

Also, another object of the present invention is to provide a method of detecting a remaining amount of a developer contained in a developer containing portion, in an image forming apparatus using a developing device having a developer carrying member that develops an electrostatic latent image formed on an electrophotographic photosensitive member using a developer; a developer containing portion that contains the developer; an agitating member provided rotatably in the developer containing portion to agitate the developer; and a developer amount detecting member that outputs a signal for detecting a remaining amount of a developer contained in the developer containing portion, the detecting method having: a reference value setting step of setting a reference value to be a reference for detecting a remaining amount of the developer by the signal; a remaining amount detecting step of calculating a remaining amount of the developer based on an amount of change in the signal from the reference value; a band of fluctuation detecting step of detecting a band of fluctuation in the signal corresponding to a rotational period of the agitating member; and a correction step of correcting the remaining amount of the developer calculated by the remaining amount detecting unit on the basis of a corrected value derived from the band of fluctuation.

Further features of the present invention will become apparent from the following description of exemplary embodiments with reference to the attached drawings.

DESCRIPTION OF THE PREFERRED EMBODIMENTS

Hereinafter, an image forming apparatus and a method of detecting a remaining amount of a developer according to the present invention will be described further in detail with reference to drawings.

First Embodiment

<Description of Image Forming Apparatus and Image Forming Process>

Figure 1:
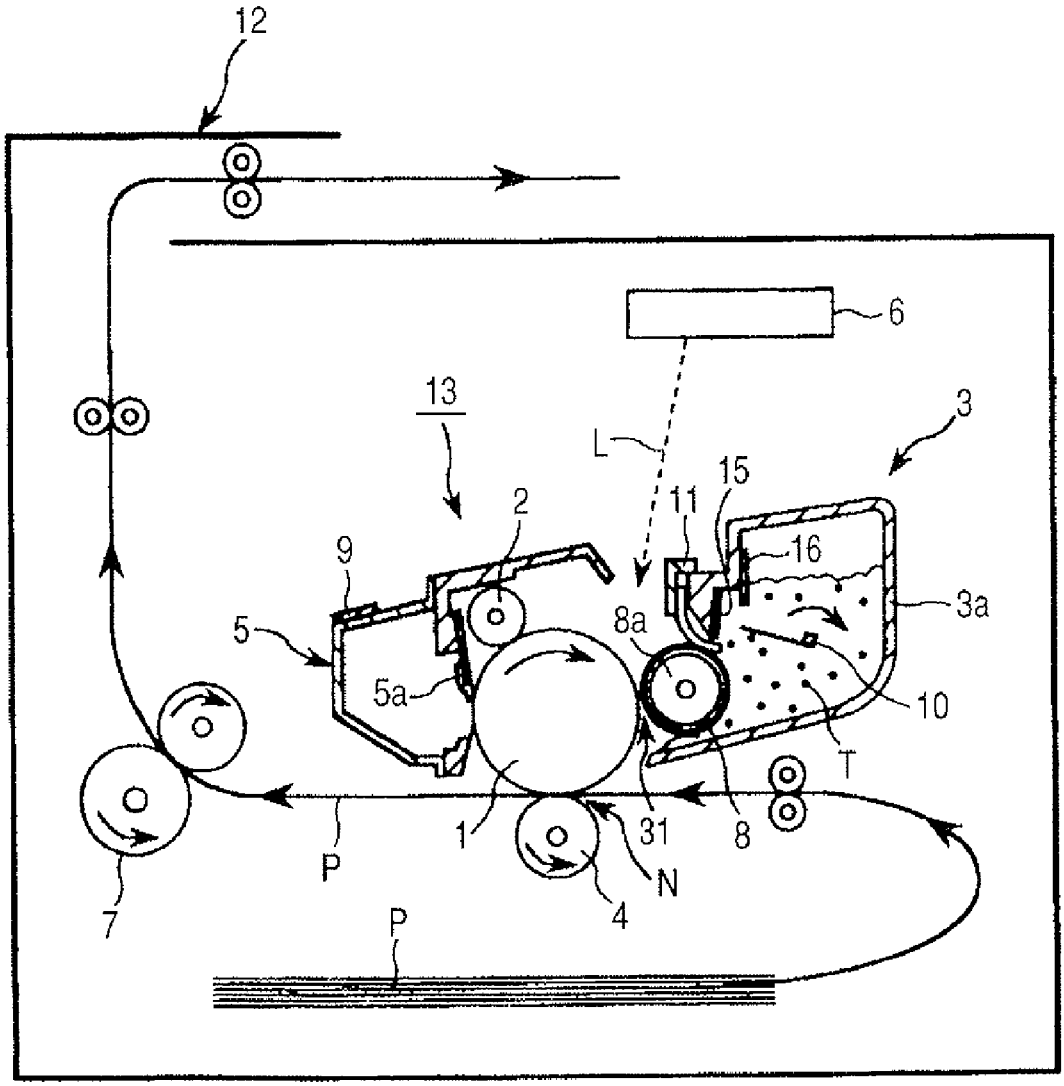
FIG. 1 is a schematic cross-sectional configuration view illustrating an embodiment of an image forming apparatus according to the present invention.

FIG. 1 illustrates a schematic configuration of a laser beam printer of electrophotographic system as an embodiment of an image forming apparatus according to the present invention.

An image forming apparatus 12 of the present embodiment utilizing electrophotography technology includes a drum-shaped electrophotographic photosensitive member (hereinafter referred to as "photosensitive drum") 1 as an image bearing member. Around the photosensitive drum 1, a charging roller 2 as a charging unit, a developing device 3 as a developing unit, a transfer roller 4 as a transfer unit, and a cleaning device 5 having a cleaning blade 5*a* as a cleaning unit are arranged in this order along a rotational direction of the photosensitive drum 1. In addition, an exposure device 6 is arranged over between the charging roller 2 and the developing device 3. A fixing device 7 is arranged at downstream side of a transfer nip N formed between the photosensitive drum 1 and the transfer roller 4 in a conveying direction of a recording sheet.

In the present embodiment, among the above component members, the photosensitive drum 1, the charging roller 2, the developing device 3, and the cleaning device 5 are integrally contained, forming a process cartridge 13 detachably mountable to an image forming apparatus main body.

In the present embodiment, the photosensitive drum 1 has an OPC (organic photoconductive) layer on a drum base body made of aluminum, and is driven to rotate in a direction shown by arrow (clockwise direction) at a predetermined circumferential speed by a driving unit (not shown) provided at an image forming apparatus main body side. The photosensitive drum 1 is uniformly charged to a negative polarity by the charging roller 2 in contact therewith in the rotation process thereof.

The charging roller 2 as a charging unit uniformly charges the photosensitive drum 1 at a predetermined polarity and potential by a charging bias applied from a charging bias power source (not shown). As a charging bias, DC voltage Vprdc corresponding to an dark space electric potential Vd on the photosensitive drum is applied with superimposed on AC voltage Vpp discharged sufficiently by the charging roller 2. An alternating current AC component of the charging bias performs a constant current control such that a constant electric current flows at any time between the photosensitive drum 1 and the charging roller 2.

The exposure device 6 outputs from a laser output portion (not shown) image information input from a personal computer (not shown) in the form of a laser beam (exposure beam) modulated in accordance with time-series electric digital image signal by a video controller (not shown). An exposure beam L makes scanning and exposure of the charged surface of photosensitive drum 1, thereby forming an electrostatic latent image corresponding to image information.

The developing device 3 includes a developing container 3*a* as a developer containing portion, and contains a developer T therein. Furthermore, there is arranged in the opening of the developing container 3*a* a developing sleeve 8 acting as a developer carrying member made of a non-magnetic developing member such as aluminum pipe which developing sleeve 8 is opposed to the photosensitive drum 1 surface, and is capable of rotating with keeping a predetermined distance. Further, an agitating member 10 rotatable in a direction shown by arrow for agitating a developer and a developing blade 11 for frictionally charging a developer on the developing sleeve 8 are included within the developing container 3*a*. In the present embodiment, the developer T uses mono-component magnetic developer (hereinafter referred to as "toner") with a mean particle size of 7 μm. The developer is not limited to mono-component magnetic toner.

The agitating member 10 uses a PPS sheet having a thickness of 100 μm, and makes one revolution in approximately 3 seconds in this embodiment. Toner T is conveyed to the developing sleeve 8 with this agitating member 10. The toner T is taken in by the developing sleeve 8, being regulated in its layer thickness by the developing blade 11 and simultaneously charged due to frictions, and then fed to a developing region 31. The developing blade 11 is an elastic blade made of e.g., urethane rubber, and brought into contact with the developing sleeve 8 under a predetermined pressure, to provide an electric charge necessary for development to toner T and to regulate the layer thickness of toner on the developing sleeve 8.

Toner T is made to adhere to an electrostatic latent image on the photosensitive drum 1 in the developing region 31 to develop this image as a toner image. In the developing sleeve 8, a magnet roller 8*a* in which a plurality of magnetic poles N and S, being a magnetic field generating unit are alternately formed, is arranged in an immobilized manner with respect to the developing sleeve 8. The magnet roller 8*a* makes no rotational movement, held in a constant position at all times, and kept in the same polar direction.

In this embodiment, as toner T, as described above, a mono-component magnetic developer is used to make a reversal development. A developing bias in which a direct current DC is superimposed on an alternating current AC is applied from a developing bias power supply 80 (FIG. 3) to the developing sleeve 8. With this developing bias, the toner T fed into the developing region 31 flies from the developing sleeve 8 onto the photosensitive drum 1. In this embodiment, as a developing bias, a rectangular wave with a DC voltage Vdc=−500 V, an AC voltage of Vpp=1500 V, and frequency of 2500 Hz is used.

The transfer roller 4 as a transfer unit is contacted with the photosensitive drum 1 surface under a predetermined pressure force to form a transfer nip portion N, and is applied with a transfer bias from a transfer bias power supply (not shown). With this transfer bias, toner images on the photosensitive drum 1 surface are transferred to recording sheets P such as papers at the transfer nip portion N between the photosensitive drum 1 and the transfer roller 4.

The fixing device 7 includes a heating roller provided with a halogen heater (not shown) in an internal part and a pressure roller. While a recording sheet P is being sandwiched and conveyed at the fixing nip between the fixing roller and the pressure roller, a toner image having been transferred onto the surface of the recording sheet P is heated, fused, and pressed to be heat-fixed, thus to be a permanent image. The permanent image on the recording sheet P which fixing is ended is discharged outside of the image forming apparatus 12.

The cleaning blade 5*a* as a cleaning unit makes cleaning of toner not having been transferred onto the photosensitive drum 1 and remaining, and the photosensitive drum 1 is devoted again for image formation.

The process cartridge 13 is filled with toner of 500 g in this embodiment, and has a product life of 10,000 sheets at a coverage rate of 4% printing of A4 papers.

<Description of Toner Remaining Amount Detection>

Figure 2:
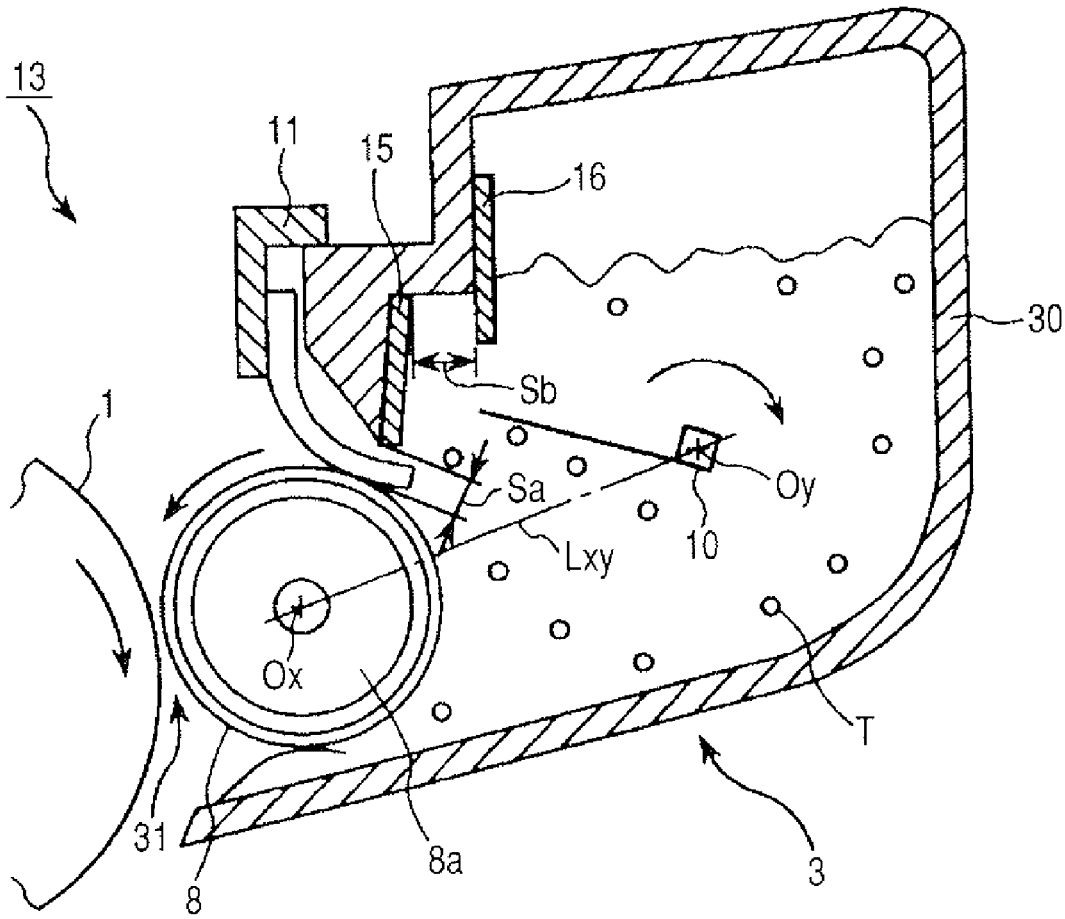
FIG. 2 is a schematic cross-sectional configuration view illustrating an embodiment of a developing device to which the present invention is applicable.
Figure 3:
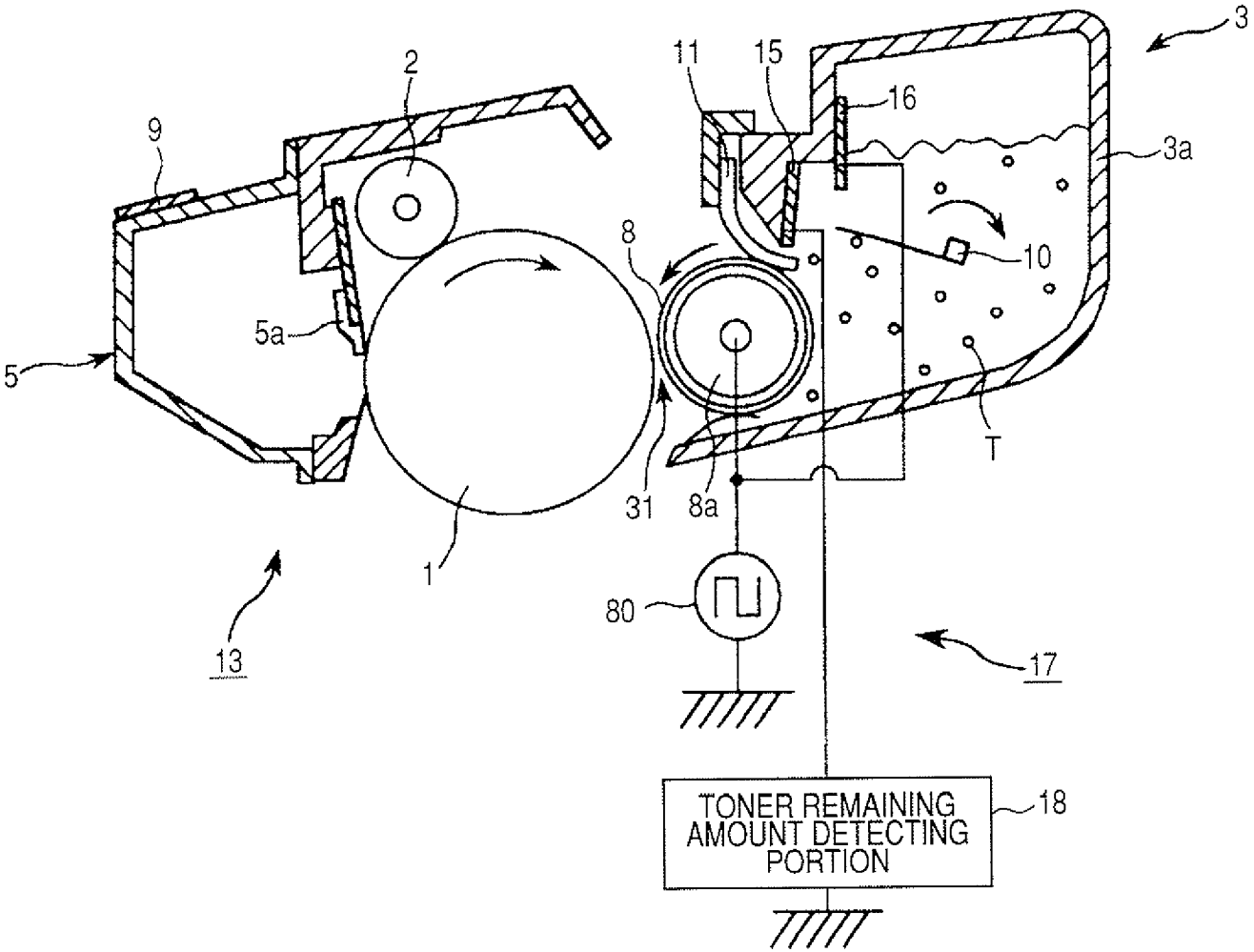
FIG. 3 is a schematic cross-sectional configuration view illustrating an embodiment of a process cartridge to which the present invention is applicable.

Next, a toner remaining amount detecting unit 17 utilizing the change in capacitance values for use in this embodiment is described referring to FIG. 2 and FIG. 3.

A developer remaining amount detecting member for detecting the remaining amount of developer, namely, a detecting electrode including a toner remaining amount detecting unit 17 is arranged within the developing device 3 of the process cartridge 13. In the present embodiment, two parallel metal plates of a plate antenna metal plate (hereinafter referred to as "PA metal plate") 15 as a developer amount detecting electrode and a PA metal plate 16 extend in a longitudinal direction within the process cartridge, and are securely arranged so as to be opposed to each other. Also, the PA electrodes 15, 16 are arranged between the developing sleeve 8 and the agitating member 10.

The developing bias with a superimposing of direct current and alternating current components is applied from a power source 80 to the developing sleeve 8, thus causing the toner to fly to the photosensitive drum 1. A remaining amount detecting bias is applied from the same power source 80 to the PA metal plate (a first electrode) 16. At this time, an electric current value induced at the PA metal plate (a second electrode) 15 can be measured, and capacitances between PA metal plates 15, 16, or between PA metal plate 15 and the developing sleeve 8 can be measured by a toner remaining amount detecting portion 18.

When a remaining amount of toner is large, it means a condition in which the toner is sufficiently filled within the developing device 3, that is, the developing device 3 is full of toner. Accordingly, this can be detected by measuring capacitance between PA metal plates 15, 16. Whilst, when a remaining amount of toner is small, it means a condition in which only a small amount of toner remains within the developing device 3, to the degree that the toner is only present in the vicinity of developing sleeve 8. Accordingly, this can be detected by measuring a capacitance between the PA metal plate 15 and the developing sleeve 8.

The PA metal plate 16 is an input electrode member into which a detected voltage in the developer remaining amount detecting unit 17 of the image forming apparatus 13 is input. Also, the PA metal plate 15 functions as an output electrode member that outputs a capacitance corresponding to an amount of developer (a remaining amount of toner) present between the PA metal plate 15 and PA metal plate 16 or the developing sleeve 8 to the image forming apparatus 12.

A capacitance C between the PA metal plates 15, 16, namely, two pieces of electrode members has a relationship among an area A of PA metal plates 15, 16, a distance d, a relative permittivity $K_\epsilon$ between two pieces of PA metal plates 15, 16 as expressed in the following expression (1).

$$C=K_\epsilon \times A/d \quad (1)$$

The relative permittivity $K_\epsilon$ is a value that varies with the amount of toner between the PA metal plates. When the percentage of toner between the PA metal plates is large $K_\epsilon$ becomes large, and when the percentage of toner between the PA metal plates is small $K_\epsilon$ becomes small. From this fact, the remaining amount of toner can be linked with capacitance, and thus the remaining amount of toner is converted from the relative permittivity $K_\epsilon$.

As a configuration used in the present embodiment, non-magnetic SUS plates with an area A=15 $cm^2$ are used for the PA metal plate 15 and the PA metal plate 16. A distance Sa between the developing sleeve 5 and the PA metal plate 15 is 5 mm, and a distance Sb between the PA metal plate 15 and the PA metal plate 16 is 15 mm. In the present embodiment, non-magnetic SUS plates (SUS316-CP) are used, but any materials that have electrical conductivity may be used without being specially limited.

<Description of Toner Remaining Amount Detecting Circuit>

Next, one example of a toner remaining amount detecting circuit comprising the toner remaining amount detecting unit 17 used in the present embodiment will be described with reference to FIG. 4 and FIG. 5.

Figure 4:
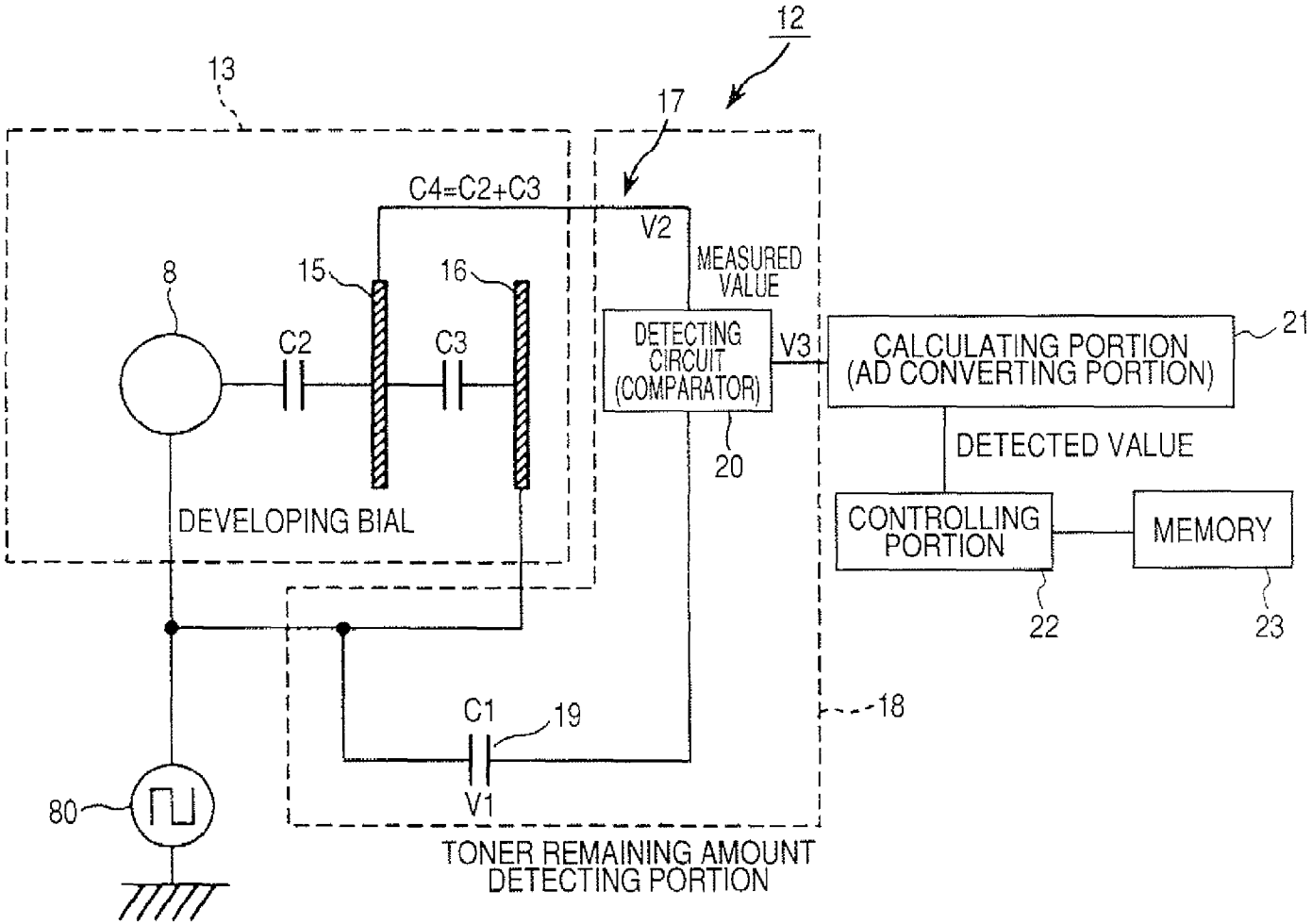
FIG. 4 is a block diagram illustrating a developer remaining amount detecting circuit.

FIG. 4 illustrates a circuit configuration of the toner remaining amount detecting unit 17 within the image forming apparatus 12 when the process cartridge 13 is normally mounted to the image forming apparatus 12. The image forming apparatus 12 and the process cartridge 13 are provided with electrical contacts (not shown). When the process cartridge 13 is mounted to the image forming apparatus 12, the PA metal plates 15, 16 and a toner remaining amount detecting portion 18 within the image forming apparatus 12 are electrically connected through the electrical contacts.

When a predetermined AC bias is outputted from the developing bias power source 80 as a developing bias applying unit, the applied bias is applied to a capacitor 19 for reference (capacitor C1; fixed value), the developing sleeve 8, and the PA metal plates 16 for inputting, respectively. Thereby, a voltage V1 is generated at the both ends of the capacitor 19 for reference. And, a voltage V2 is generated for a combined capacitance (C4=C2+C3) of capacitance (capacitance C2; variable depending on the remaining amount of toner) between the developing sleeve 8 and the PA metal plates 15, and capacitance between the PA metal plates 15, 16 (capacitance C3; variable depending on the remaining amount of toner).

A detecting circuit 20 generates a voltage V3 that is a measured value from a voltage difference between the voltages V1, V2, and outputs the resulting voltage V3 to an AD converting portion 21. The AD converting portion 21 outputs the results of digital-conversion of the analog voltage V3 to a controlling portion 22. The controlling portion 22 calculates the amount of developer within the process cartridge estimated from a voltage value V converted into this digital value (hereinafter referred to as "detected value", Unit: V). Since the developing bias is used for measurements, the measurement of the remaining amount of toner is also performed concurrent with a developing process.

Figure 5:
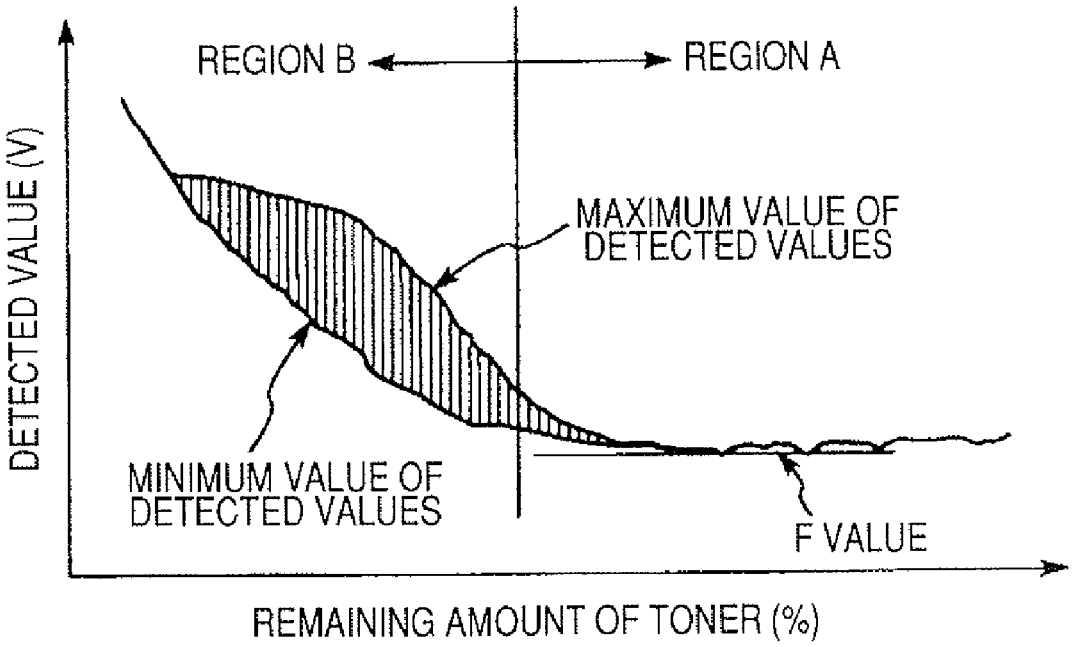
FIG. 5 is a graph illustrating a relationship between a remaining amount of toner and a detected value.

As described above, a detected value detected by the toner remaining amount detecting portion 18 is converted into a voltage at the controlling portion 22 of the image forming apparatus main body, and in usual case, it is outputted in voltage value V as in FIG. 5. In the present embodiment, it is so configured that the smaller a remaining amount of toner becomes (the smaller a capacitance C4 becomes), the larger a detected value becomes. The image forming apparatus 12 detects its remaining amount successively in response to the consumption of toner T within a developing container 3*a* with the toner remaining amount detecting unit 17.

In the system of the present embodiment, a toner near end system is adopted, where a detected value does not change greatly up to a region A in FIG. 5, whilst from the time point when the remaining amount of toner has decreased down to a certain small point, namely, from a region B, the remaining amount can be detected successively.

<Storage Unit (Memory)>

Figure 6:
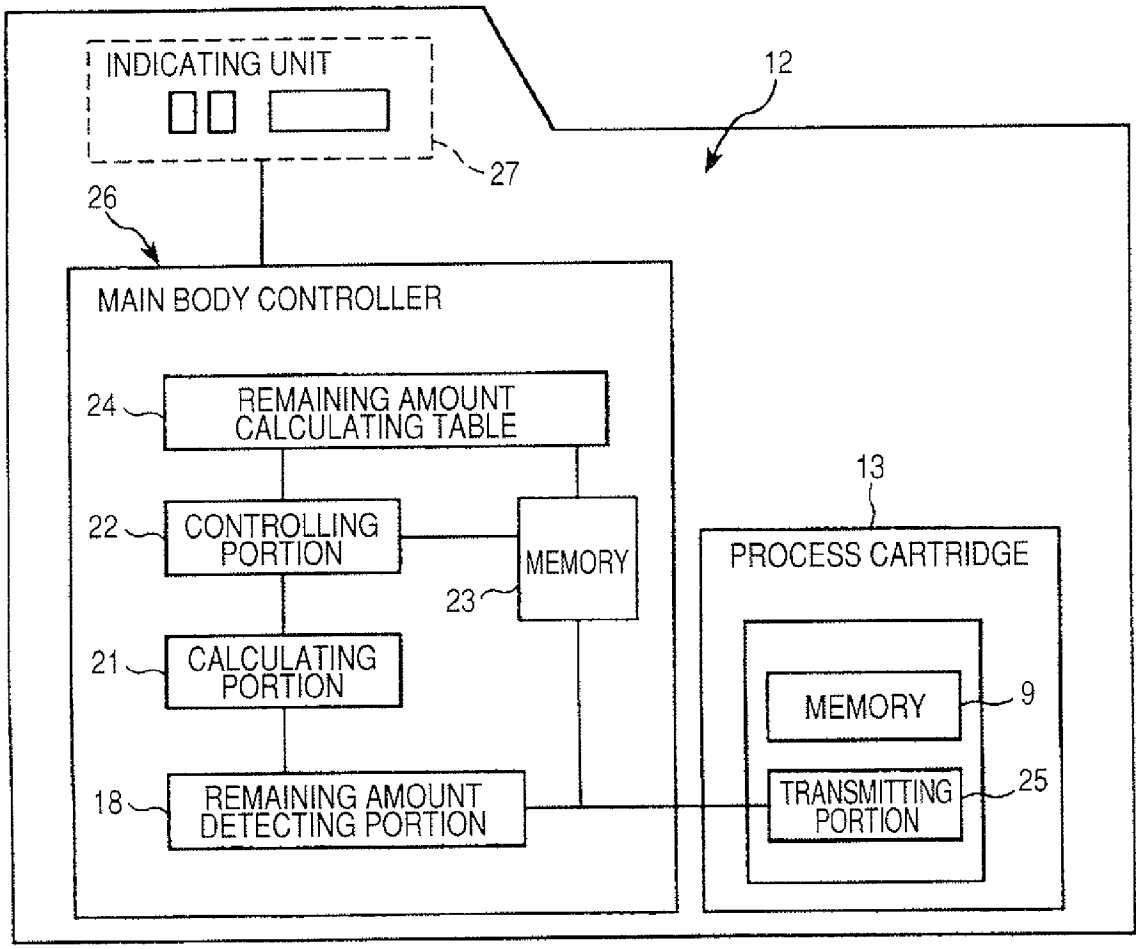
FIG. 6 is a block diagram of a main body controller.

Next, a storage unit will be described with reference to FIG. 6.

There is provided a storage unit (memory) 9 at a process cartridge 13. In addition, the process cartridge 13 is provided with a transmitting portion 25 on the process cartridge side for controlling write and read of information into and from this memory 9. In the case where the process cartridge 13 is mounted onto the image forming apparatus 12 main body, the cartridge transmitting portion 25 and the main body controller 26 are located opposed to each other. This main body controller 26 also includes functions as a transmitting unit on the main body side.

The main body controller 26 includes a toner remaining amount detecting portion 18, a calculating portion 21, a controlling portion 22 and a main body side memory 23. The main body controller 26 forms a controlling unit for calculating remaining amounts of toner estimated from detected values having been detected on the cartridge 13 side, and for making write and read of information of the cartridge side memory 9.

Although, in this embodiment, a nonvolatile memory of contact type is employed as the memory 9, a non-contact type memory making data communication with an electromagnetic wave, the combination of a volatile memory and a backup power supply, or the like causes no problem. The information written in the cartridge side memory 9 is sent to the main body side memory 23 when the process cartridge 13 begins to be used.

<Toner Remaining Amount Calculation>

Figure 7:
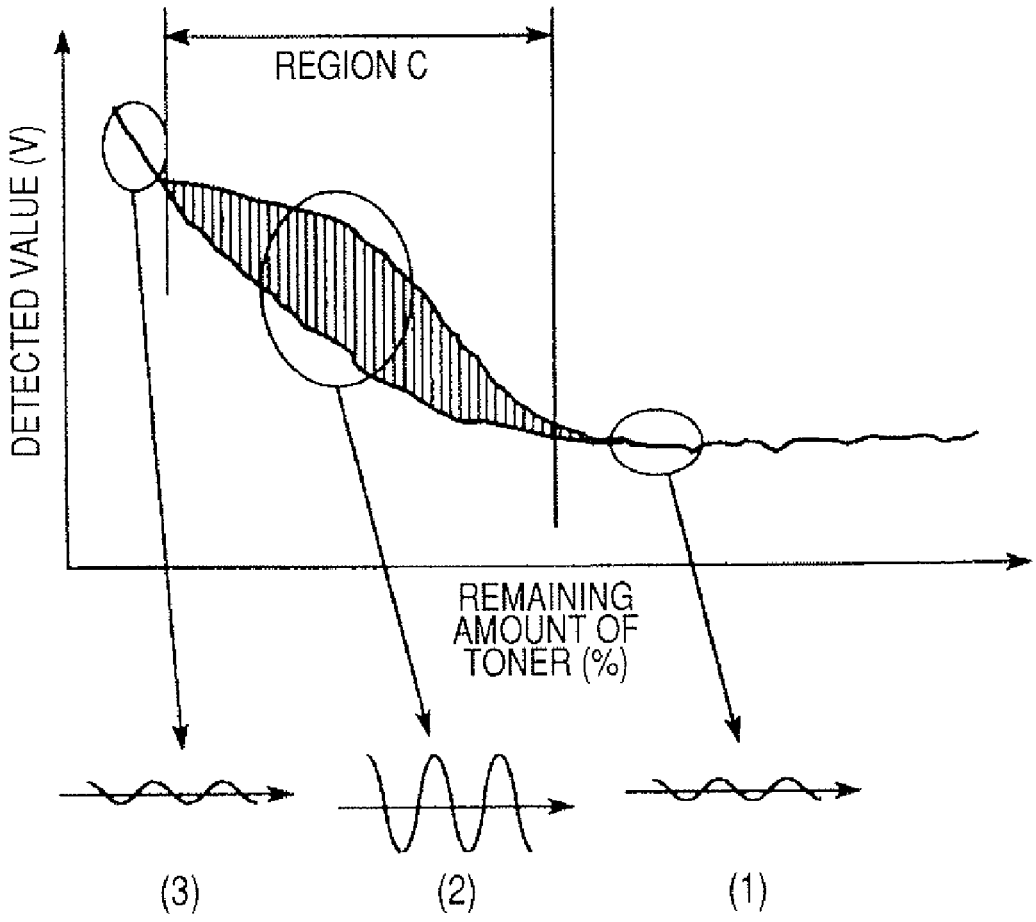
FIG. 7 is a graph illustrating a relationship between a remaining amount of toner and a deviation of detected value.

As illustrated in FIG. 5, detected values are changed as toner remaining amounts change. To observe the change in detected voltages in detail, however, as illustrated in FIG. 7, detected voltages are found to go up and down in synchronization with the period of rotation of an agitating member 10. The reason thereof is, as illustrated in FIG. 8A, FIG. 8B, FIG. 8C and FIG. 8D, that amounts of toner between the PA metal plates 15 and 16 change accompanied by movement of the agitating member 10.

Figure 8A:
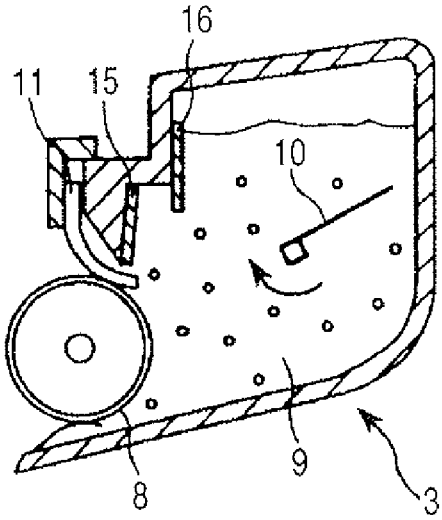
FIG. 8A, FIG. 8B, FIG. 8C and FIG. 8D are schematic cross-sectional views illustrating a movement of toner and agitation within a developing device.

When toner between the PA metal plates 15 and 16 is largely moved, since capacitances C3 change, detected values largely fluctuate. As illustrated in FIG. 8A, in the state in which toner sufficiently remains (corresponding to (1) of FIG. 7), toner between the PA metal plates 15 and 16 do not largely change even if the agitating member 10 is rotated, and thus detected values do not fluctuate much in the period of agitation.

Figure 8B:
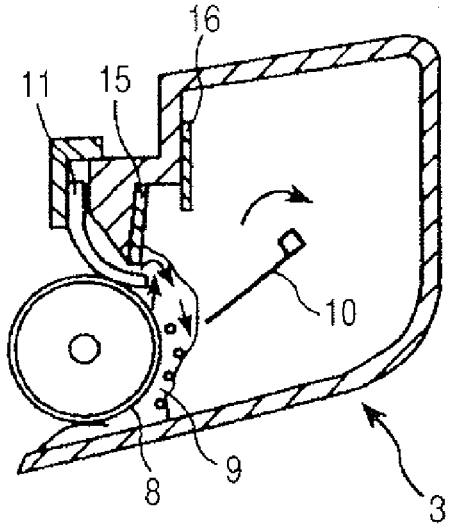

Likewise, as illustrated in FIG. 8B, also in the state in which there are substantially small amounts of toner (corresponding to (3) of FIG. 7), since the agitating member 10 has not reached the region in which toner is resided even if the agitating member 10 rotates, toner T moves only in the vicinity of the developing sleeve 8 and the developing blade 11 as indicated by the arrow in FIG. 8B. Accordingly, detected values hardly fluctuate in the period of agitation.

Figure 8C:
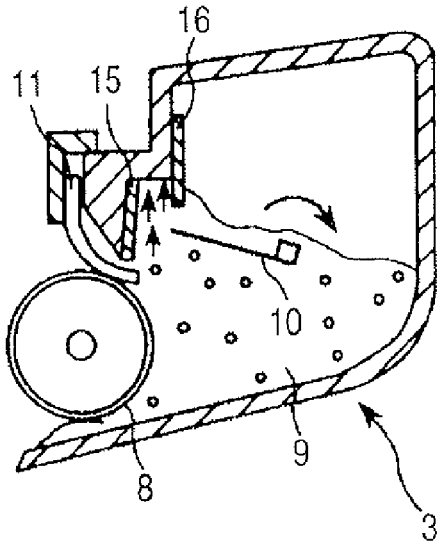
Figure 8D:
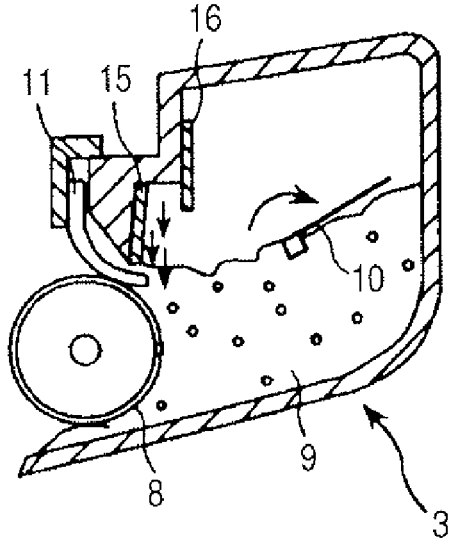

As illustrated in FIG. 8C and FIG. 8D, however, in the case of a certain amount of toner, toner amounts between the PA metal plates 15 and 16 largely change by the rotation of the agitating member 10. Therefore, detected vales largely fluctuate in the period of agitation (corresponding to (2) of FIG. 7).

In the case where the agitating member 10 pushes toner between the PA metal plates 15 and 16 as illustrated in FIG. 8C, the capacitance between the PA metal plates 15 and 16 becomes large, and thus a detected value becomes small. On the other hand, when the agitating member 10 goes away from the PA metal plates 15 and 16 as illustrated in FIG. 8D, toner drops from between the PA metal plates 15 and 16 owing to gravity, the capacitance therebetween becomes small, and thus a detected value becomes large. Since these states are repeated in the period of agitation, fluctuation in detected values are significantly large in a region C of FIG. 7.

If the detected values are adopted as they are, their variations are large, and therefore stable detection of the remaining amount cannot be performed.

Now, in the present embodiment, an averaging processing is performed with respect to the detected values obtained from the rotating period (three seconds/one revolution) of the agitating member 10.

Namely, sampling is made for every 10 msec for the detected values, which is repeated for three seconds. An average value (hereinafter referred to as "average output value") is obtained by averaging the detected values amounting to 256 points obtained there. By adopting the average output value, stable correspondence between the remaining amount of toner and the detected value can be established as illustrated in FIG. 9 (A description of F value and E value as shown in FIG. 9 will be given later)

Figure 10:
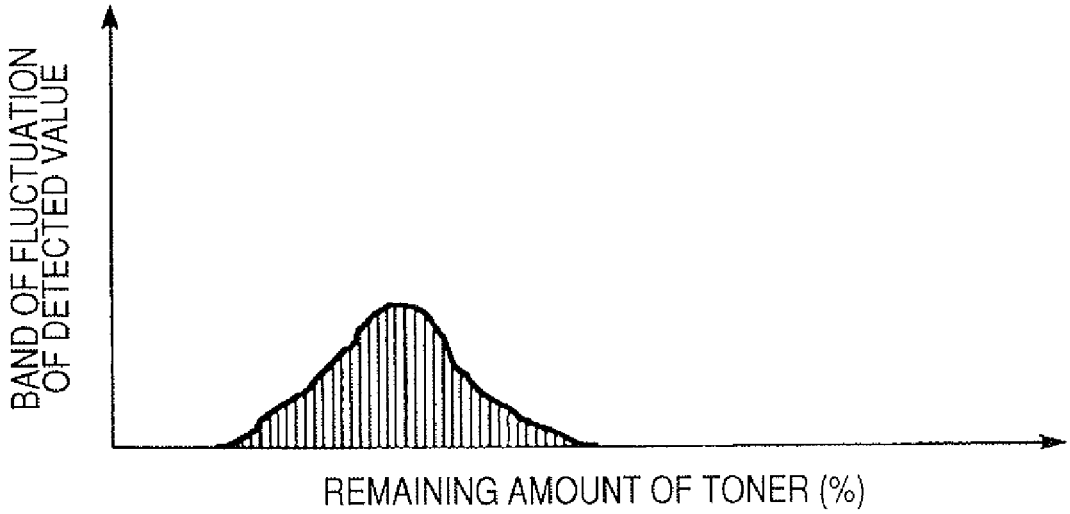
FIG. 10 is a graph illustrating a relationship between a remaining amount of toner and a band of fluctuation in detected value.

Further, in the present embodiment, a difference between a maximum value and a minimum value (hereinafter referred to as "output fluctuation value") among the detected values of 256 points is obtained in parallel with an average output value. The output fluctuation value is such that its band of fluctuation varies depending on the remaining amount of toner as illustrated in FIG. 5 and FIG. 7. A band of output fluctuation progresses as illustrated in FIG. 10 relative to the remaining amount of toner. In a range where the remaining amount of toner is sufficiently enough, the band of output fluctuation is hardly detected. However, if the amount is reached enough to create a space between the PA metal plates 15, 16, the detected values fluctuate substantially at the agitating period, and the output fluctuation value becomes large too. Further, the toner becomes small in volume, the influence of the agitating member 10 disappears, and thus the band of output fluctuation converges again.

Figure 9:
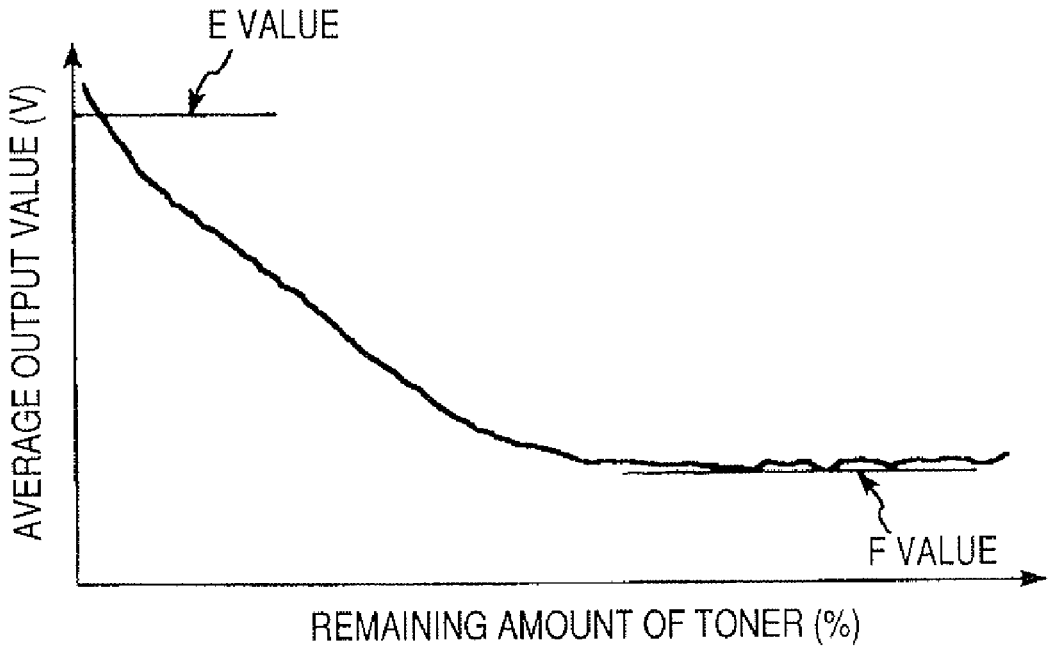
FIG. 9 is a graph illustrating a relationship between a remaining amount of toner and an average output value.

Accordingly, the progress of the detected values becomes like FIG. 5 and FIG. 7, but two progresses of the average output value as shown in FIG. 9 and the output fluctuation value as shown in FIG. 10 are obtained by the above processing from these values.

According to the study by the present inventors, the average output value often results in changing up and down due to a use environment for the main body of the image forming apparatus, a use condition for the toner, adherence of a small amount of toner to the PA metal plates, and other factors. For instance, in a case where a use environment for the image forming apparatus is at high humidity, the toner takes up moisture, and thus a capacitance value becomes large, resulting in that the average output value takes a lower value. On the contrary, in a case where a use environment is at low humidity, or deterioration of the toner progresses, the average output value results in taking a higher value because a capacitance value becomes small.

In particular, in a condition where the remaining amount of toner is small (FIG. 8B), that is, there is little toner between the PA metal plates 15, 16, a capacitance value detected constitutes only a capacitance C2 between the PA metal plate 15 and the developing sleeve 8. At this time, if toner adheres on the PA metal plates 15, a capacitance value C3 between the PA metal plates 15, 16 increases, which is considered to have an impact on a combined capacitance C4 detected too. In this case, if the average output value is used as it is for the calculation of the remaining amount of toner, the toner shows a smaller amount in reality. Even if C2 decreases, an extra capacitance by an adhered toner is detected in C3. For this reason, it follows that a capacitance value, which does not coincide with actual amount of toner, may be detected as the entire C4, and consequently the accuracy of toner remaining amount detection becomes worse. In the worst case, the toner on the developing sleeve 8 runs out, there is a possibility that "OUT OF TONER" may not be detected, even if a blank area condition develops.

On the other hand, however, the output fluctuation value is determined mainly by the amount of toner that goes and comes between the PA metal plates 15, 16 and it is extremely rare that this is dependent on the use environment or the use condition of toner. When toner becomes small in volume, and decreases down to such a volume that a capacitance C2 between the PA metal plate 15 and the developing sleeve 8 becomes predominant, toner on the agitating member 10 has surely run out. Accordingly, there is little chance that the output fluctuation value be detected. Whilst, when toner is sufficient enough in volume (FIG. 8C or FIG. 8D), regardless of use environment or the condition of toner, the toner repeats to go and come between the PA metal plates 15, 16. Therefore, it follows surely that the output fluctuation value rises and falls substantially.

In particular, in the present embodiment, the PA metal plates 15, 16 are arranged above the developing sleeve 8. In other words, as illustrated in FIG. 2, the PA metal plates 15, 16 are arranged between the developing sleeve 8 and the agitating member, and over a straight line Lxy that connects the center of rotation Ox of the developing sleeve 8 to the center of rotation Oy of the agitating member 10. Thereby, the toner moves surely in and out between the PA metal plates 15, 16, and the influence of the agitating member 10 disappears at the point when it has been consumed down to a certain amount. As a result, even if the average output values have up-and-down variations resulting from individual differences, it was revealed through the verification of plural process cartridges that a relationship between the output fluctuation value and the remaining amount of toner changes little and is kept constant.

Accordingly, detecting the remaining amount of toner with a high accuracy becomes possible by correcting the calculated remaining amount of toner based on the average output values using the relationship between the output fluctuation value and the remaining amount of toner.

Figure 11:
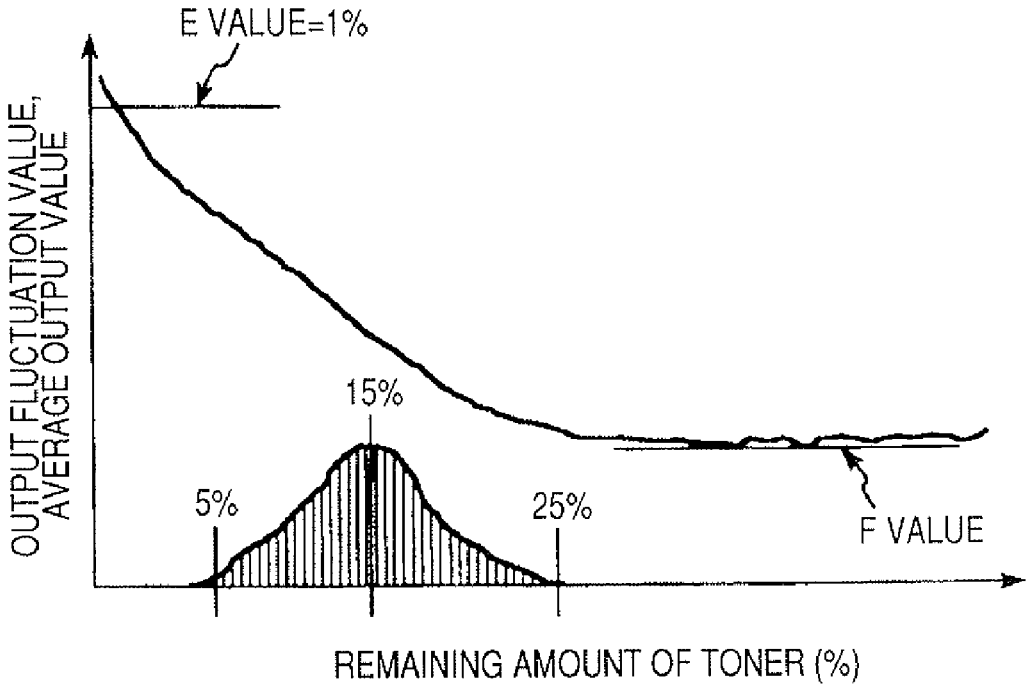
FIG. 11 is a graph illustrating a relationship between a remaining amount of toner, and an average output value and an output fluctuation value in a first embodiment of the present invention.

In the present embodiment, as illustrated in FIG. 11, the remaining amount of toner is about 25% at a position where the output fluctuation value begins to appear, about 15% at a position where it has a peak, and about 5% at a position where the output fluctuation value converges. The relationship between the output fluctuation value and the remaining amount of toner changes little even if the average output value rises and falls. The relationship between the output fluctuation value and the remaining amount of toner changes depending on arrangement of the PA metal plates 15, 16, agitating strength of the agitating member 10, attitude of the developing container 3*a*, and the like. Thus, it is necessary to set the relationship according to the range to be detected, or the like.

The output fluctuation values are stable at beginning-to-fluctuate position, peak position, and fluctuation converging position, and it is possible to detect the remaining amounts of toner of 25%, 15%, and 5%, respectively. Since the entire band of fluctuation is not so large, it is difficult to increment successively a percent (%) between the above percents. Incidentally, in the present embodiment, the calculation of toner remaining amount detection is corrected based on the output fluctuation value in accordance with the sequence as discussed later (a second detecting unit).

<Remaining Amount of Toner Calculation>

Normal calculation of the remaining amount of toner requires the setting of a reference value. For detected values, detected voltages vary in response to change in the remaining amount of toner, as illustrated in FIG. 7, from which average output values as illustrated in FIG. 9 are obtained. From the average output values, a value that changes little is taken as a reference value for toner remaining amount detection, and a toner remaining amount detection is effected using an amount of change from the reference value (a first detecting unit).

The reference value according to the present embodiment uses a minimum value (hereinafter referred to as "F (Plate Antenna Full)", written as "F value") of average output values in a condition in which toner is sufficiently filled, namely, a full condition (maximum value as capacitance value). The reason why this part is used as a reference value toner is that both detected values in the condition in which toner is sufficiently much, and average output values calculated from these are most stable. The F value will be updated whenever necessary when detected value yields a minimum value (capacitance is maximum value), while the image forming apparatus is in service.

Each of the process cartridge 13 and the image forming apparatus 12 has a manufacturing tolerance, an individual difference occurs in F value serving as the reference value. The difference results from capacities of developing bias, capacitor, size of PA metal plates, and shift from a position installed. Hence, accurate detection of the remaining amount of toner can be made by measuring F values for each cartridge and detecting the remaining amount of toner according to the amount of change from the values.

Further, the calculation of the remaining amount of toner is performed using this F value and table illustrating the relationship between the ratio of amount of change and the indicated remaining amount as shown in Table 1 retained beforehand in a remaining amount calculating table 24 within the main body controller 26.

In the table of the present embodiment, toner remaining amount detection is conducted in 1% increments for the remaining amount of 20% (toner weight of about 100 g) or under. And, a point where a blank area image is generated is taken as a remaining amount of toner 0%, and a "TONER OUT" indication informs a user of that residual toner is very small when a remaining amount of toner 1% is detected. The "TONER OUT" indication is designed to be given to an indicating unit 27 (FIG.6) of the image forming apparatus main body.

In the main body controller 26, the average output value (hereinafter referred to as "E (plate antenna empty)", written as "E value") that performs toner OUT display from F value is calculated by the equation (2).

$$E=a\times F+b \tag{2}$$

Constants a, b in the equation are the values determined by the accumulation of experimental data. In the present embodiment, a=1.75, b=−0.1 were given.

Next, ratios of amount of change Z from F values of average output values V are determined by the following equation (3).

$$\text{Ratio of amount of change } Z=(\text{average output value } V-F)/(E-F) \tag{3}$$

Corresponding remaining amount that exceeds the ratio of change is indicated from the ratio of amount of change Z determined by the equation (3) and the Remaining Amount Calculating Table shown in Table 1.

For example, in the case of average output value V =1.76 V, F value=1.50 V, the ratio of change is 0.25 from the above equation (2), and the equation (3), then remaining amount of 10% is indicated from the Remaining Amount Calculating Table in Table 1.

TABLE 1

| Ratio of Change Z from F Value | Indicated Remaining Amount (%) |
|---|---|
| 0.15 | 20 |
| 0.17 | 19 |
| 0.19 | 18 |
| 0.21 | 17 |
| 0.23 | 16 |
| 0.24 | 15 |
| 0.28 | 14 |
| 0.31 | 13 |
| 0.32 | 12 |
| 0.35 | 11 |
| 0.38 | 10 |
| 0.42 | 9 |
| 0.46 | 8 |
| 0.5 | 7 |

TABLE 1-continued

| Ratio of Change Z from F Value | Indicated Remaining Amount (%) |
|---|---|
| 0.58 | 6 |
| 0.63 | 5 |
| 0.69 | 4 |
| 0.75 | 3 |
| 0.85 | 2 |
| 1 | 1 |

The remaining amount of toner is calculated by the above-mentioned method when printing (when applying developing bias), the remaining amount of toner is indicated on an indicating unit 27 provided in the image forming apparatus 12. In a case where the remaining amount of toner is changed and updated, the indication on the indicating unit 27 is updated whenever necessary. These calculated values, and the remaining amounts of toner are stored in a cartridge side memory 9 each time they are calculated.

Figure 12:
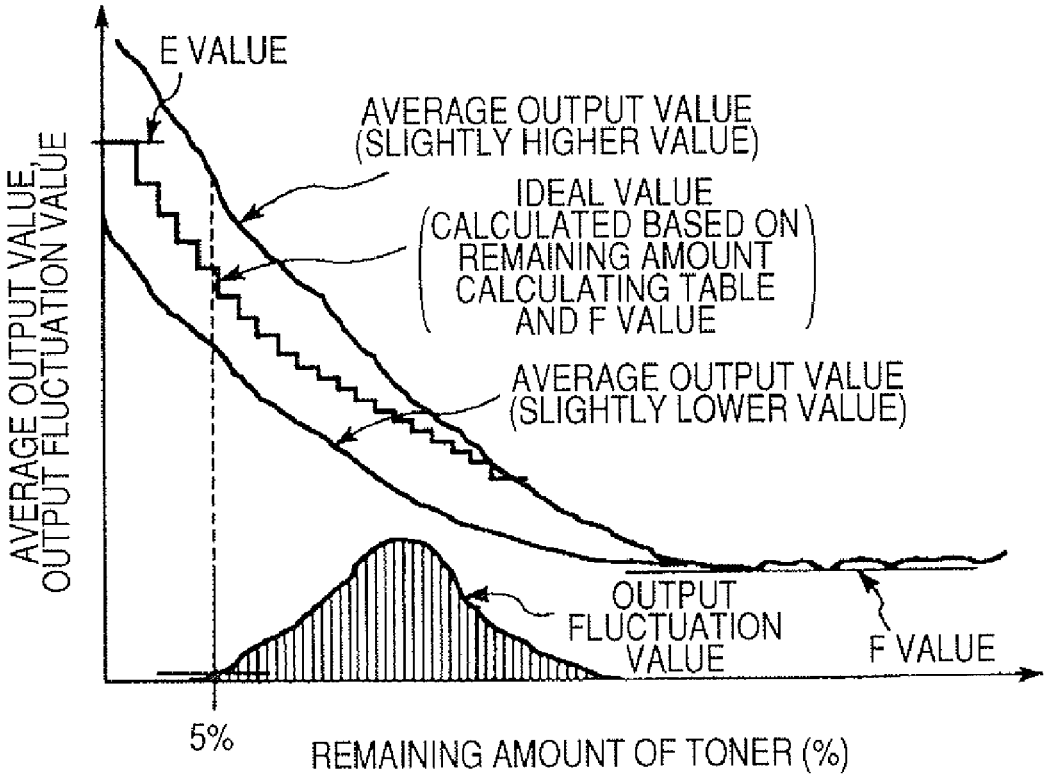
FIG. 12 is a graph illustrating a relationship between a remaining amount of toner, and an average output value, an output fluctuation value and an ideal value in the first embodiment of the present invention.

As illustrated in FIG. 12, the remaining amounts of toner from 20% to 1% are calculated in 1% increments based on F value and Remaining Amount Calculating Table. Calculated value is so called an ideal value, and actual average output values may be possibly detected drifting up and down. This is due to individual difference in the process cartridge. Specifically, it is attributable to the developing bias, capacitance of capacitor, size of PA metal plate, and manufacturing tolerance such as deviation from installed position, or use environment of the image forming apparatus main body, use condition of toner, and a small amount of toner adhering to PA metal plates.

However, whatever average output value is taken by the process cartridge, the average output value takes nearly constant value at a position where output fluctuation value converges. In the present embodiment, regardless of the value of average output value, the output fluctuation value converges when the remaining amount of toner is about 5%.

<Remaining Amount of Toner Correction>

Figure 13:
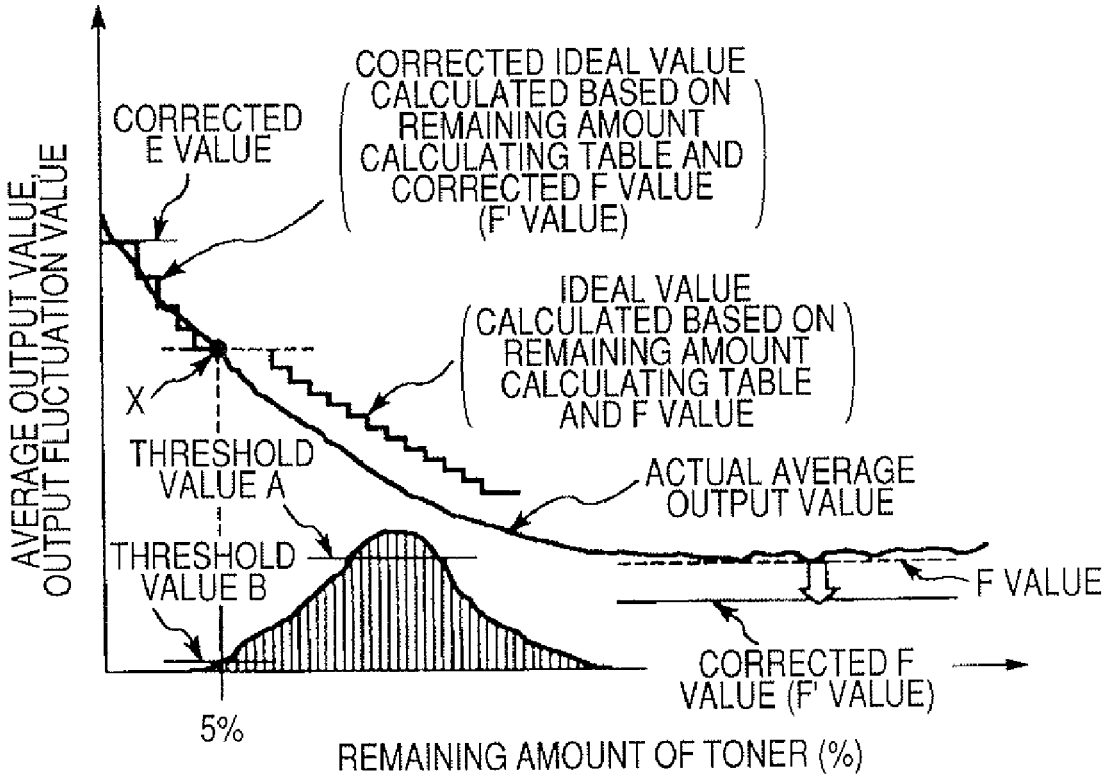
FIG. 13 is a graph illustrating a relationship between a remaining amount of toner, and an average output value, an output fluctuation value, and an ideal value in the first embodiment of the present invention.

The present embodiment takes advantage of the fact that a relationship between a position where the output fluctuation value converges and the remaining amount of toner is constant without depending on individual difference and use environment of the process cartridge. Namely, as illustrated in FIG. 13, the average output value (average output value X in FIG. 13) at a point when the output fluctuation value converges is regarded as an ideal value (value of 5%) determined by the Remaining Amount Calculating Table, and F value that has been definite so far is changed. Also, regarding whether or not an output fluctuation value became large once and then has converged, predetermined threshold values A, B are set for output fluctuation values, as illustrated in FIG. 13, and it is determined that the output fluctuation value has reached a peak when the threshold value A is exceeded. Subsequently, it is determined that a point when an output fluctuation value is close to 0 (a point when an output fluctuation value is smaller than threshold value B), gives an ideal value (value of 5%).

Correction is effected as follows: Specifically, F value is inversely calculated so that an average output value at a point when an output fluctuation value has been determined smaller than the threshold value B may become an ideal value (value of 5%), and then that value is taken as a new F value.

To give specifically, from the equations (4) and (5) below to calculate the remaining amount of toner:

$$E=a\times F+b \quad (4)$$

$$\text{Ratio of Change } Z=(\text{Average output Value } V-F)/(E-F) \quad (5)$$

Then we get the following equation (6):

$$F'=(\text{Average output Value } V-\text{Ratio of Change } Z\times B)/(\text{Ratio of Change } Z\times(a-1)+1) \quad (6)$$

F' value obtained from the equation (6) is taken as corrected F value.

In the present embodiment, ratio of change Z at the time of 5%=0.63, and a=1.75, b=−0.1, corrected F value (=F') determined by the equation (6) is given by the following equation (7).

$$F'=(\text{Average output value } V-0.63\times(-0.1))/(0.63\times(1.75-1)+1)=(\text{Average output value } V+0.063)/(1.4725) \quad (7)$$

Thus, the influence of drift of average output value can be controlled by changing F value regarding actual average output value V as an ideal value, and thus enhancement of accuracy in toner remaining amount detection becomes possible.

<Correction Sequence>

Figure 14:
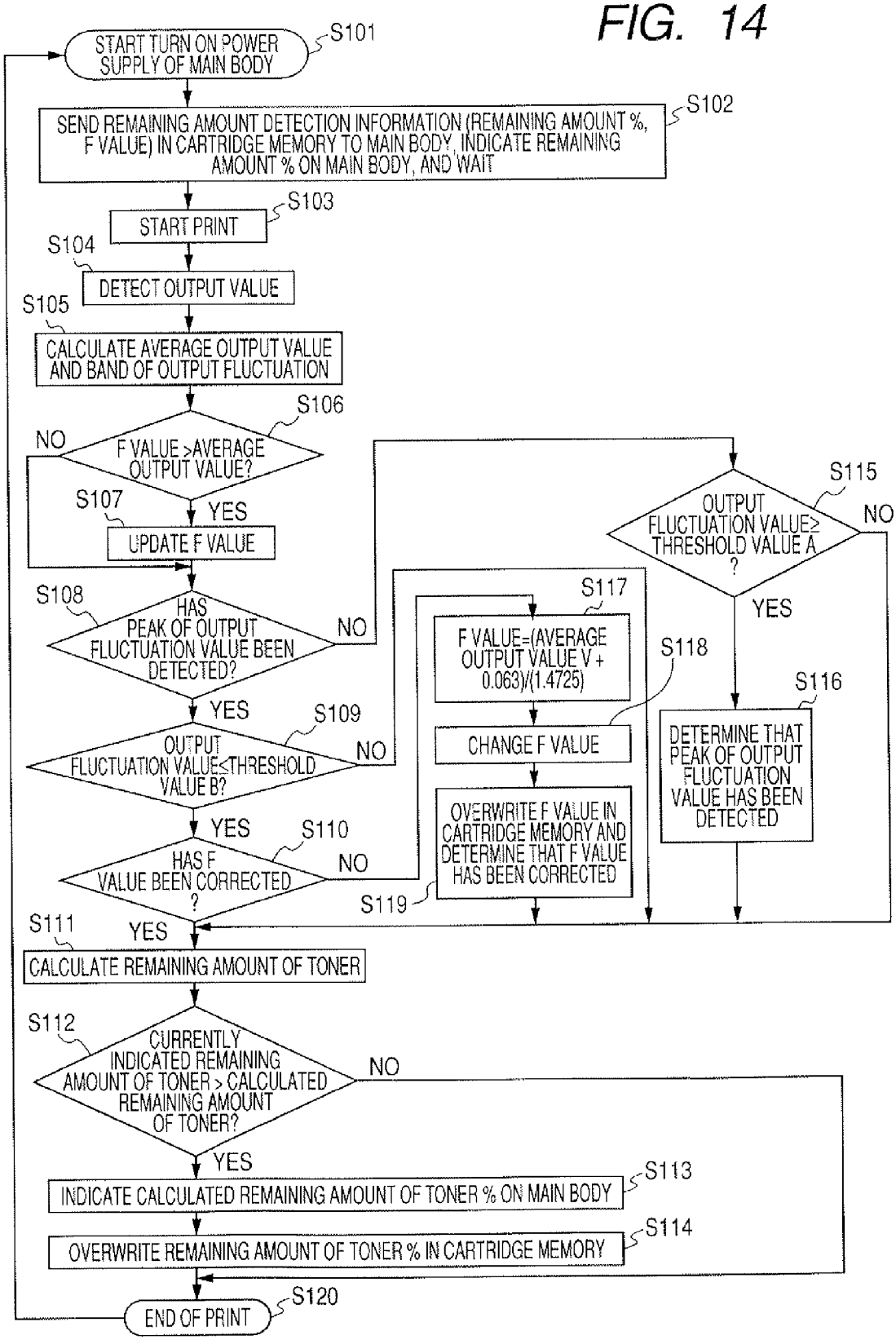
FIG. 14 is a flow chart illustrating a toner remaining amount detecting control in the first embodiment of the present invention.

A characteristic method of calculating the remaining amount of toner in the present embodiment will be described with reference to a flow chart in FIG. 14.

First, a toner remaining amount detecting control starts by turning the power supply ON (S101).

The controlling portion 22 of the main body controller 26 reads remaining amount detection information (F value, E value, and an indicated remaining amount value (%)) stored in the cartridge side memory 14. Then, the controlling portion 22 stores the read information into a main body side memory 23, indicates the remaining amount of toner on the indicating unit 27 in a case where indicated remaining amount value (%) has been stored, and proceeds to a print standby state (S102)

When a printing operation starts (S103), the controlling portion 22 detects the output of the developer remaining amount detecting circuit corresponding to the remaining amount of toner as a detected value, and repeats the operation during one period of the agitating member (three seconds in the present embodiment) (S104). Average output value, and output fluctuation value are calculated from among 256 values of the detected values, respectively (S105). As discussed above, the average output value is an average value of 256 points, and the output fluctuation value is difference value between a maximum and minimum values of 256 points.

Next, a comparison is made between F value that is currently stored in the main body side memory 23, and calculated average output value (S106). In a case where F value is smaller than the average output value, the operation proceeds to S108. In a case where the average output value is smaller than F value, this average output value is taken as a new F value, and then F value in the main body side memory 23 is updated (S107).

Next, the controlling portion 22 determines whether or not a peak of the output fluctuation value has been detected (S108).

In a case where a peak of the output fluctuation value has not been detected yet, the operation proceeds to S115. In a case where the peak of the output fluctuation value has been detected, the operation proceeds to S109 to determine whether or not the output fluctuation value has been converged. In a case where the output fluctuation value has not been converged yet, the operation proceeds to S111. In a case where the output fluctuation value has been converged, the remaining amount of toner is predicted to be just under 5%, accordingly the operation proceeds to S110 to determine the correction.

In a case where a correction has not yet been made, the operation proceeds to S117. In a case where the correction has already been made, the operation proceeds to S111 to calculate the remaining amount of toner based on F value and a toner remaining amount detecting table 24. In a case where calculated remaining amount of toner is larger than currently indicated remaining amount of toner, the printing operation ends without changing currently indicated remaining amount of toner (S120).

On the other hand, in a case where calculated remaining amount of toner is smaller than currently indicated remaining amount of toner, calculated remaining amount of toner is indicated to the main body indicating unit 27 (S113). Then, a new remaining amount of toner is overwritten in the cartridge side memory 14 (S114), then the printing operation ends (S120).

In S108, in a case where the controlling portion 22 determines that a peak of the output fluctuation value has not yet been detected, the operation proceeds to S115 to determine whether or not the output fluctuation value has exceeded a predetermined threshold value A. In a case where the output fluctuation value has not yet exceeded the threshold value A, the operation proceeds to S111 to calculate the remaining amount of toner. In a case where the output fluctuation value has exceeded the threshold value, the operation proceeds to S111 to calculate the remaining amount of toner, after determining that a peak of the output fluctuation value has been detected.

In S110, in a case where the controlling portion 22 determines that correction of F value has not been made, the operation proceeds to S117 to calculate F=(Average output value V+0.063)/(1.4725), and F value is changed (S118). Next, F value is overwritten in the cartridge side memory 14, and it is determined that F value has been corrected (S119), then operation proceeds to S111 to calculate the remaining amount of toner.

As discussed above, the toner remaining amount detecting control in the present embodiment may be summarized as follows: the toner remaining amount detecting control calculates the average output value and the output fluctuation value based on detected values detected for one period of the agitating member. Then, at a point when the output fluctuation value encounters a peak once, and converges, namely, at a point when the remaining amount of toner is determined to be 5%, the toner remaining amount detecting control corrects F value so that the average output value may become an ideal value.

Successive toner remaining amount detection is enabled by using this control, and thus the accuracy can be increased near the TONER OUT (1%=E value) where the average output values often drift greatly.

It should be noted that, in the present embodiment, detected values were obtained per one period of the agitating member, but detected values may be obtained in a longer period in order to further suppress the variations. The average output values and the output fluctuation values are obtained in the similar manner. In addition these, threshold values of the output fluctuation values may be determined as appropriate depending on configuration of the process cartridge 13 and the developing device 3, the range of the remaining amount of toner detection, and the like.

Also, in the present embodiment, since the output fluctuation values were always obtained, two threshold values of the output fluctuation values were provided: detection at a time of a peak, and detection at a time of convergence. But, a region where the output fluctuation values be obtained was limited to 20% or less of the remaining amount of toner. Accordingly, threshold value of the output fluctuation values may be provided for only one, i.e. detection at a time of convergence.

As discussed above, according to the present embodiment, the accuracy in toner remaining amount detection, particularly the accuracy just before the amount of toner is empty can be increased, and the remaining amount of toner can be sequentially detected.

Second Embodiment

Next, the second embodiment according to the present invention will be described. Basic configuration and operation of the image forming apparatus of the present invention are the same as those of the first embodiment. Therefore, same numerals and symbols are attached to the elements having substantially same as or equivalent to functions, configurations of the image forming apparatus of the first embodiment, accordingly detailed description will be omitted, and only characteristic parts to the present embodiment will be described.

<Remaining Amount of Toner Correction>

Figure 15:
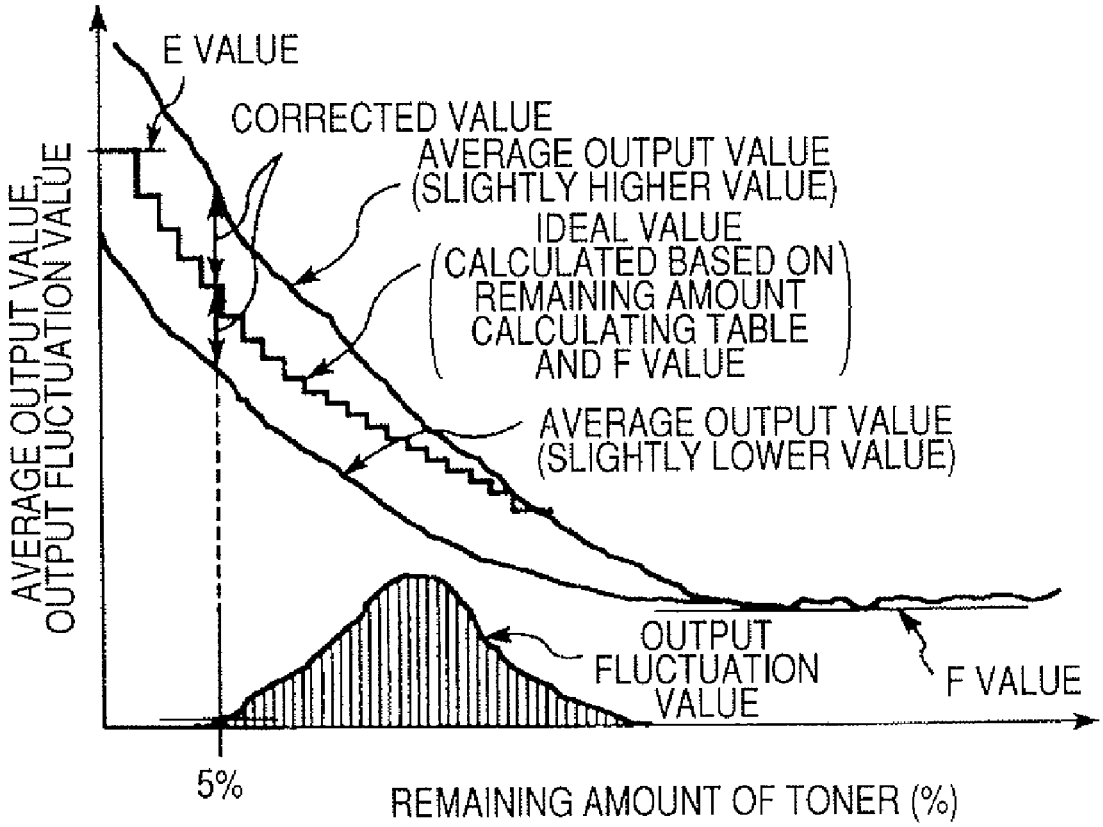
FIG. 15 is a graph illustrating a relationship between a remaining amount of toner, and an average output value, an output fluctuation value and an ideal value in the second embodiment of the present invention.

The present embodiment takes an advantage of the fact that a relationship between a position where the output fluctuation value converges and the remaining amount of toner is constant without depending on individual difference and use environment of the process cartridge. Namely, F value that has been definite so far is corrected due to a deviation from an ideal value (value of 5%) determined by F value and the remaining amount calculating table, referring to the average output value at a time point when the output fluctuation value converged (a second detecting unit). A predetermined threshold value (not shown) is provided for the output fluctuation value as illustrated in FIG. 15, and in a case where the threshold value is exceeded, it is determined that the output fluctuation value has reached a peak. After that, it is advisable to determine whether or not the output fluctuation value became large one time, and subsequently converged at a point when the output fluctuation value is close to zero (takes a value of one or less in the present embodiment). The information about whether or not the output fluctuation value has converged is preserved in the cartridge side memory 9.

The correction is calculated as a (average output value−ideal value)=corrected value, at a point when the output fluctuation value has been determined to be 5%, and the corrected value is added to F value. Therefore, in a case where the average output value is smaller than the ideal value, corrected value takes negative value, F value will be corrected to smaller value. Conversely, in a case where the average output value is larger than the ideal value, corrected value takes positive value, and F value will be corrected to larger value. By correcting the F value, a value calculated based on the toner remaining amount detecting table (1%=E value included) tends to rise and fall as a whole, and thus toner remaining amount detection consistent with each cartridge becomes possible. The information about whether or not the F value has been corrected is preserved in the cartridge side memory 9.

<Correction Sequence>

Figure 16:
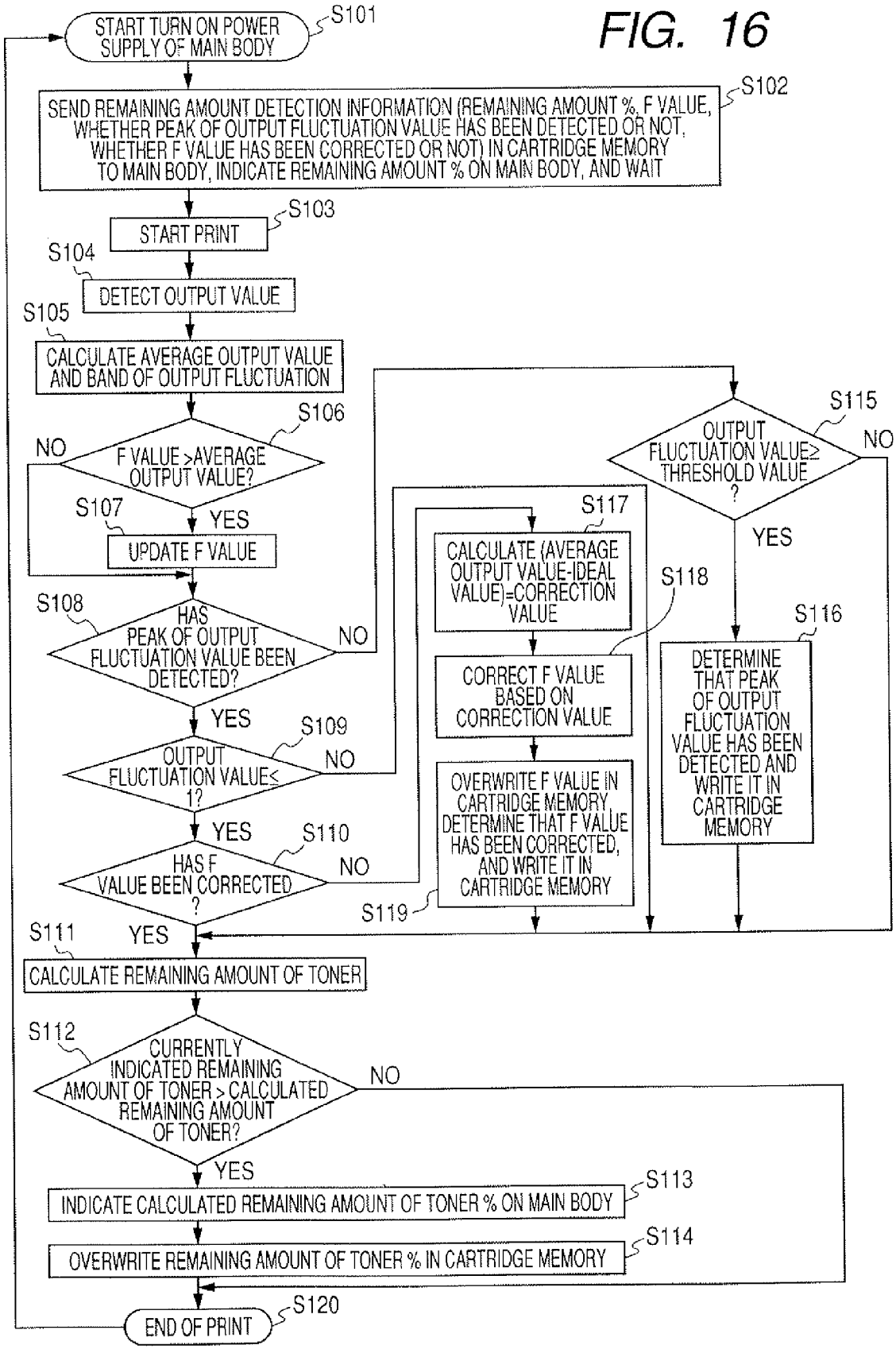
FIG. 16 is a flow chart illustrating a toner remaining amount detecting control in the second embodiment of the present invention.

A characteristic method of detecting the remaining amount of toner in the present embodiment will be described in the flow chart in FIG. 16.

First, a toner remaining amount detecting control is started by turning the power supply on (S101).

The controlling portion 22 of the main body controller 26 reads the remaining amount detecting information (F value, E value, and indicated remaining amount value (%), whether or not a peak of the output fluctuation values has been detected, whether or not F value has been corrected) stored in the cartridge side memory 9, and stores the information into the main body side memory 23. At this time, in a case where the indicated remaining amount value (%) has been stored, the controlling portion 22 causes the indicating unit 27 to indicate the remaining amount of toner, and proceeds to a Wait Print state (S102).

When a printing operation starts (S103), the controlling portion 22 detects an output of the developer remaining amount detecting circuit that corresponds to the remaining amount of toner as a detected value, and repeats the operation for one period (three seconds in the present embodiment) of the agitating member. From among the values of 256 points of indicated values, the average output value and the output fluctuation value are calculated respectively (S105). As described above, the average output value is an average value of 256 points, and the output fluctuation value is a difference between a maximum value and a minimum value.

Next, a comparison is made between F value that is currently stored in the main body side memory 23, and calculated average output value (S106). In a case where F value is smaller than the average output value, the operation proceeds to S108. In a case where the average output value is smaller than F value, this average output value is taken as a new F value, and then F value in the main body side memory 23 is updated (S107).

Next, the controlling portion 22 determines whether or not a peak of the output fluctuation value has been detected (S108).

First, whether or not a peak of the output fluctuation value has been detected is checked referring to the main body side memory 23. In a case where a peak of the output fluctuation value has not yet been detected, the operation proceeds to S115. In a case where the peak of the output fluctuation value has been detected, the operation proceeds to S109 to determine whether or not the output fluctuation value has come to be one or less. In a case where the output fluctuation value is not one or less, the operation proceeds to S111. In a case where the output fluctuation value is one or less, the remaining amount of toner is predicted to be just under 5%, accordingly the operation proceeds to S110 to determine the correction.

In S110, the controlling portion 22 determines whether or not F value has been corrected according to the information in the main body side memory 23. In a case where the correction has not yet been made, the operation proceeds to S117. In a case where the correction has been made, the operation proceeds to S111 to calculate the remaining amount of toner based on F value and the toner remaining amount detecting table 24. In S112, in a case where calculated remaining amount of toner is larger than currently indicated remaining amount of toner, the printing operation ends without changing currently indicated remaining amount of toner (S120).

On the other hand, in S112, the controlling portion 22 determines whether or not calculated remaining amount of toner has come to be smaller than currently indicated remaining amount of toner. In a case where the calculated remaining amount of toner takes a smaller value than currently indicated remaining amount of toner, the calculated remaining amount of toner is indicated on the main body indicating unit 27 (S113). Then, a new remaining amount of toner is overwritten on the cartridge side memory 9 (S114), then the printing operation ends (S120).

In S108, as discussed above, the controlling portion 22 determines whether or not a peak of the output fluctuation value has been detected. This determination is executed referring to the main body side memory 23, depending on whether or not the peak of the output fluctuation value has been detected. In a case where the peak has not been detected, in S115, the controlling portion 22 determines whether or not the output fluctuation value has exceeded a predetermined threshold value. In a case where the output fluctuation value has not yet exceeded the threshold value, the operation proceeds to S111 to calculate the remaining amount of toner. In a case where the output fluctuation value has exceeded the threshold value, the operation proceeds to S116 to determine that the peak of the output fluctuation value has been detected and to write it in the cartridge side memory 9. Then, the operation proceeds to S111 to calculate the remaining amount of toner.

In S110, in a case where the controlling portion 22 determines that correction of F value has not yet been made, the operation proceeds to S117 to calculate F=(average output value−ideal value)=corrected value. And, correction is executed by adding corrected value to F value (S118).

Next, the F value is overwritten in the cartridge side memory 9; it is determined that F value has been corrected (S119); F value is written in the cartridge side memory 9, and then operation proceeds to S111 to calculate the remaining amount of toner.

As discussed above, the toner remaining amount detecting control in the present embodiment may be summarized as follows: the average output value and the output fluctuation value are calculated based on detected values detected for one period of the agitating member. Then, at a time point when the output fluctuation value (namely, band of fluctuation) encounters a peak once, then converges, namely, at a time point when the remaining amount of toner is determined to be 5%, F value is corrected assuming a difference between the ideal value and the average output value to be corrected value as the corrected value.

Successive toner remaining amount detection is enabled by using this control, and thus the accuracy can be increased near the TONER OUT (1%=E value) where the average output values often deviate greatly.

It should be noted that, in the present embodiment, detected values were obtained per one period of the agitating member, but detected values may be time in a longer period in order to suppress the variations. The average output values and the output fluctuation values are obtained in the similar manner. In addition these threshold values of the output fluctuation values may be determined as appropriate depending on configuration of the process cartridge 13 and the developing device 3, the range of the remaining amount of toner detection, and the like.

As discussed above, according to the present embodiment, the accuracy in toner remaining amount detection, particularly the accuracy just before the amount of toner is empty can be increased, and the remaining amount of toner can be sequentially detected.

Third Embodiment

Next, the third embodiment according to the present invention will be described.

Basic configuration and operation of the image forming apparatus of the present invention are the same as those of the first embodiment and the second embodiment. Therefore, the same symbols are added to the elements having substantially same as or equivalent to functions, configurations of the image forming apparatus of the first embodiment, accordingly detailed description will be omitted. Hereinafter, only characteristic parts to the present embodiment will be described.

<Calculation, Correction of Remaining Amount of Toner>

The characteristic of the present embodiment is to correct the calculation of the remaining amount of toner with respect to the toner remaining amount detecting table. In the First Embodiment, corrected value was calculated based on the value of the output fluctuation value, and correction was made to F value. However, in this case, the accuracy in a region of 5% or less that is close to TONER OUT becomes high, whilst in a region of 5% or more, there is few case where any correction is applied. In the present embodiment, the accuracy of toner remaining amount detection can be enhanced as a whole from a region where the amount of toner is larger.

In the present embodiment, referring to a difference between the average output value and the ideal value at a time point when a peak position of the output fluctuation value is estimated to be 15% of the remaining amount of toner, a suitable table is selected among plural toner remaining amount detecting tables based on the difference.

Figure 17:
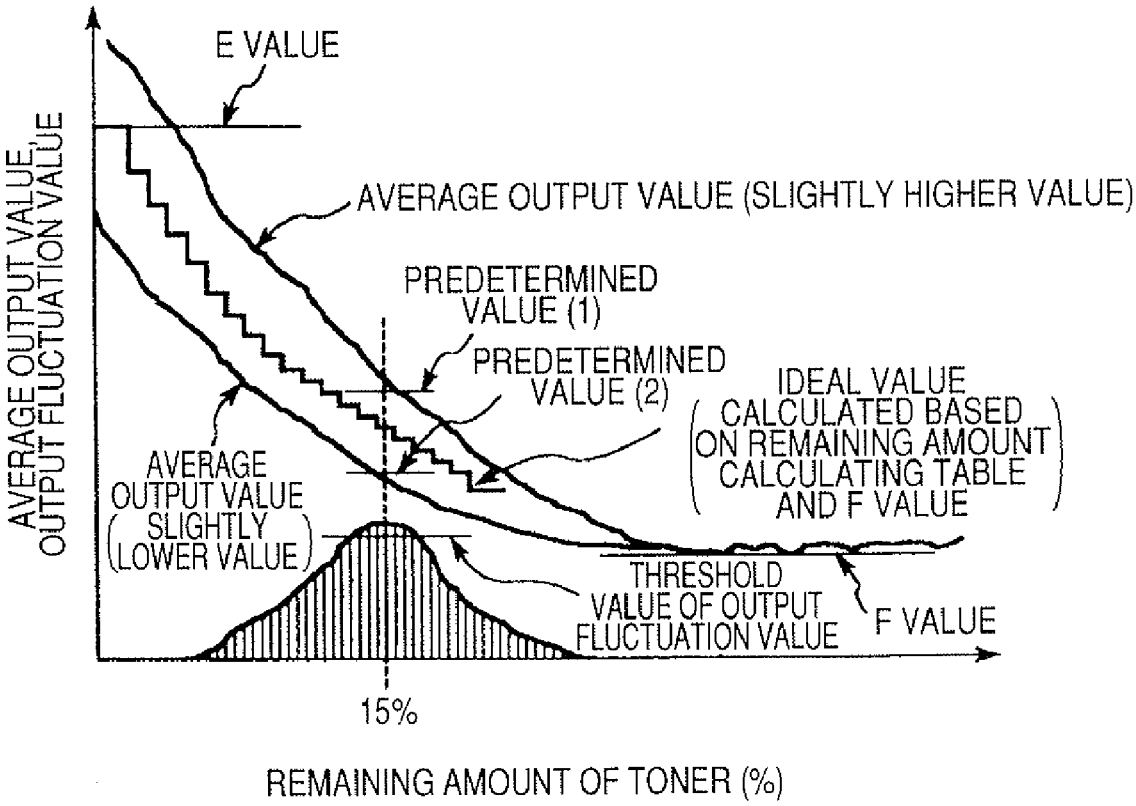
FIG. 17 is a graph illustrating a relationship between a remaining amount of toner, and an average output value, an output fluctuation value and an ideal value in the third embodiment of the present invention.

As illustrated in FIG. 17, an estimated remaining amount of toner is 15% at a time point when the output fluctuation value exceeds the threshold value, namely, close to a peak position of an output fluctuation value progression. The average output value at this time has a fluctuation as illustrated in FIG. 17.

Figure 18:
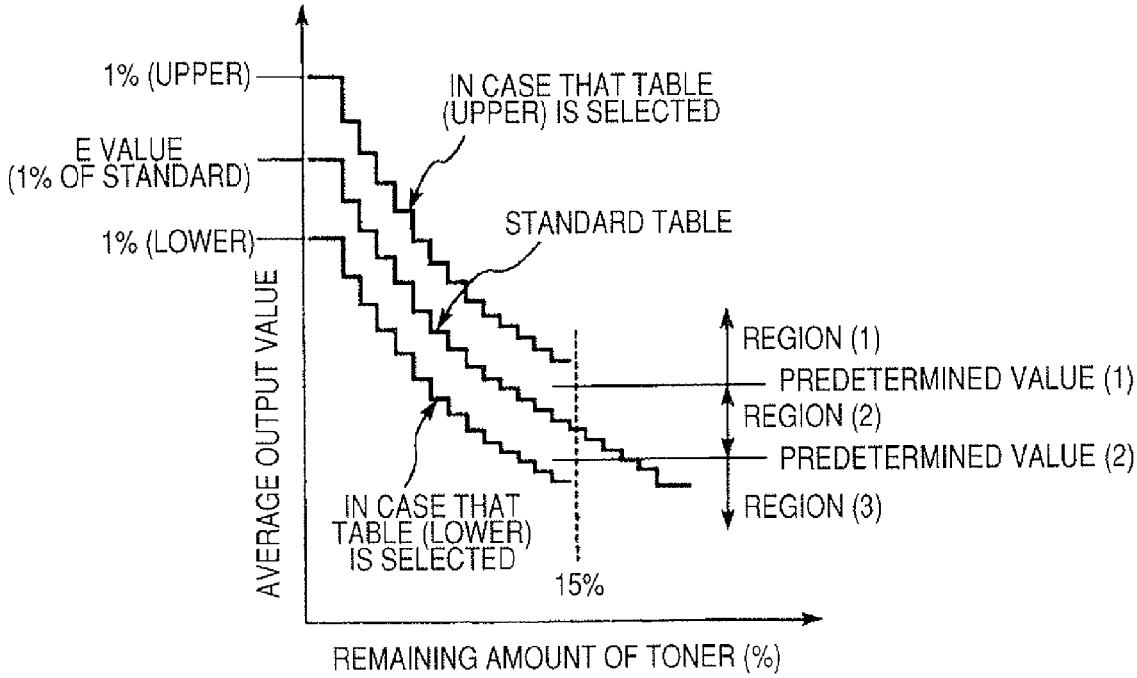
FIG. 18 is a graph illustrating another example of a relationship between a remaining amount of toner and an ideal value in the third embodiment of the present invention.

Now, as illustrated in FIG. 18, two values of predetermined values (1), (2) are provided. Then, it is determined to what region among the following three regions an average output value belongs:

Region (1): Average output Value≦ Predetermined Value (1)

Region (2): Predetermined Value (1)< Average output Value≦ Predetermined Value (2), and Region (3): Average output Value< Predetermined Value (2)

In a case where the average output value belongs to slightly higher region (1), a table (upper) is selected, whilst the average output value belongs to slightly lower region (3), a table (lower) is selected.

In a case where the average output value belongs to the region (2), a table of standard is selected. In the present embodiment, three tables are set, and values in each table are set as illustrated in Table 2.

TABLE 2

| Ratio of Change Z from F Value | | | Indicated Remaining |
|---|---|---|---|
| Table (Upper) | Standard Table | Table (Lower) | Amount (%) |
| | 0.15 | | 20 |
| | 0.17 | | 19 |
| | 0.19 | | 18 |
| | 0.21 | | 17 |
| | 0.23 | | 16 |
| | 0.24 | | 15 |
| 0.28 | 0.27 | 0.25 | 14 |
| 0.32 | 0.30 | 0.27 | 13 |
| 0.36 | 0.32 | 0.29 | 12 |
| 0.38 | 0.35 | 0.32 | 11 |
| 0.44 | 0.38 | 0.35 | 10 |
| 0.50 | 0.42 | 0.37 | 9 |
| 0.55 | 0.46 | 0.39 | 8 |
| 0.61 | 0.50 | 0.44 | 7 |
| 0.68 | 0.58 | 0.49 | 6 |
| 0.75 | 0.63 | 0.55 | 5 |
| 0.82 | 0.69 | 0.59 | 4 |

TABLE 2-continued

| Ratio of Change Z from F Value | | | Indicated Remaining |
|---|---|---|---|
| Table (Upper) | Standard Table | Table (Lower) | Amount (%) |
| 0.89 | 0.75 | 0.64 | 3 |
| 0.98 | 0.85 | 0.73 | 2 |
| 1.18 | 1.00 | 0.84 | 1 |

In the present embodiment, calculation of E value, and calculation of ratio of amount of change Z are the same as those of the First Embodiment.

In FIG. 18, F value is designed to be the same value even in the case any table is selected. Calculated E value is the same as the remaining amount of toner 1% (TONER OUT) in a case where standard table is selected. In a case where table (upper) or table (lower) is selected, E value does not become the remaining amount of toner 1%. For the standard table, when the ratio of amount of change Z is 1.0, namely, the average output value becomes E value, the remaining amount of toner is calculated as 1%.

For the table (upper), when the ratio of amount of change Z is 1.18, the remaining amount of toner is indicated as 1%, whilst for the table (lower), when the ratio of amount of change Z is 0.84, the remaining amount of toner is indicated as 1%, respectively.

<Correction Sequence>

Figure 19:
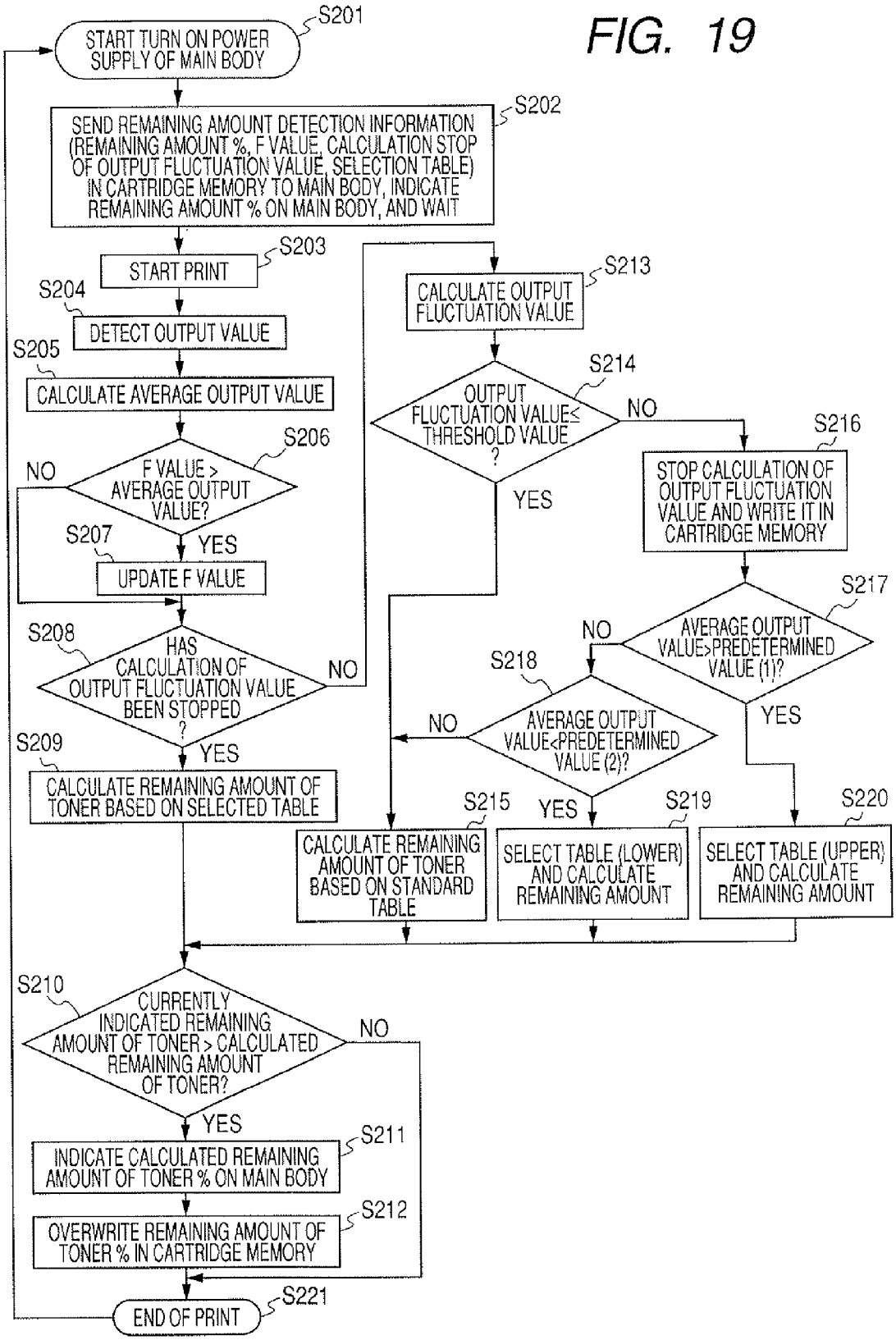
FIG. 19 is a flow chart illustrating a toner remaining amount detecting control in the third embodiment of the present invention.

A characteristic method of calculating the remaining amount of toner in the present embodiment will be described with reference to a flow chart in FIG. 19.

First, a toner remaining amount detecting control starts by turning the power supply ON (S201).

The controlling portion 22 of the main body controller 26 reads the remaining amount detection information (F value, E value, indicated remaining amount value (%), calculation stop of output fluctuation value, and selected tables) stored in the cartridge side memory 9, and stores the information in the main body side memory 23. Then, in a case where an indicated remaining amount value (%) has been stored, the controlling portion 22 causes the remaining amount of toner to be indicated on the indicating unit, and the operation proceeds to a Wait Print Condition (S202).

When a printing operation starts (S203), the controlling portion 22 detects the output of the developer remaining amount detecting circuit corresponding to the remaining amount of toner as a detected value, and repeats the operation during one period of the agitating member (three seconds in the present embodiment)(S204). The average output value is calculated from among 256 values of the detected values (S205). Similarly to the First Embodiment, the average output value is an average value of 256 points.

Next, a comparison is made between the F value that is currently stored in the main body side memory 23, and calculated average output value (S206). In a case where the F value is smaller than the average output value, the operation proceeds to S208. In a case where the average output value is smaller than the F value, this average output value is taken as a new F value, and then F value in the main body side memory 23 is updated (S207).

Next, the controlling portion 22 determines whether or not the calculation of the output fluctuation value has been stopped (S208). Whether or not the calculation of the output fluctuation value has been stopped is determined referring to the information in the main body side memory 23. In a case where the calculation of the output fluctuation value has not been stopped, the operation proceeds to S213. On the other hand, in a case where the calculation of the output fluctuation value has been stopped, the operation proceeds to S209 to calculate the remaining amount of toner using the selected table.

Next, in S210, the controlling portion 22 determines whether or not calculated remaining amount of toner is smaller than currently indicated remaining amount of toner. In a case where the calculated remaining amount of toner is larger than the currently indicated remaining amount of toner, the printing operation ends without changing the currently indicated remaining amount of toner (S221).

On the other hand, in S210, in a case where calculated remaining amount of toner is smaller than currently indicated remaining amount of toner, the calculated remaining amount of toner is indicated in the main body indicating unit 27 (S211). Then, a new remaining amount of toner is overwritten on the cartridge side memory 9 (S212), and the printing operation ends (S221).

In S208, in a case where it is determined that the calculation of the output fluctuation value has not been stopped, the controlling portion 22 calculates the output fluctuation value from among 256 points of detected values (S213). The output fluctuation value is a difference between a maximum value and a minimum value among 256 points, similar to the First Embodiment.

Next, in S214, the controlling portion 22 determines whether or not the output fluctuation value exceeds the threshold value. In a case where the output fluctuation value is not greater then the threshold value, the operation proceeds to S215 to calculate the remaining amount of toner using normal table, then proceeds to S210. On the other hand, the controlling portion 22 determines that the output fluctuation value has exceeded the threshold value, the operation proceeds to S216 to stop the calculation of the output fluctuation value, and to write the information that the calculation of the output fluctuation value has been stopped in the cartridge side memory 9. At this time, it is determined that the remaining amount of toner has reached 15% from the output fluctuation value.

Next, the controlling portion 22 proceeds to S217 to determine whether or not the output fluctuation value has exceeded a predetermined value (1). In a case where the output fluctuation value has exceeded the predetermined value (1) (region (1) in FIG. 18), the table (upper) is selected to calculate the remaining amount of toner (S220).

On the other hand, when the controlling portion 22 determines that the average output value is not greater than the predetermined value (1), the operation proceeds to S218. In S218, a comparison is made between the average output value and the predetermined value (2). In a case where the average output value is smaller than the predetermined value (2) (region (3) in FIG. 18), the table (lower) is selected to calculate the remaining amount of toner (S219).

On the other hand, the controlling portion 22 determines that the average output value is greater than the predetermined value (2) (region (2) in FIG. 18), the operation proceeds to S215 to calculate the remaining amount of toner using the normal table.

Whatever table is selected, information about which table is selected is written in the cartridge side memory 9.

From the time the remaining amount of toner was calculated forward, the steps after S210 are repeated.

As discussed above, the toner remaining amount detecting control in the present embodiment may be summarized as follows: the average output value is calculated based on detected values detected for one period of the agitating member. Then, the output fluctuation value is also calculated, and the best suitable table is selected depending on the average output value at a time point when the output fluctuation value (namely, band of fluctuation) reaches a peak.

The accuracy of the entire sequential toner remaining amount detection can be increased by using this control.

It should be noted that, in the present embodiment, detected values were obtained per one period of the agitating member, but detected values may be obtained in a longer period in order to suppress the variations. The average output values and the output fluctuation values are obtained in the similar manner. In addition to these, threshold values of the output fluctuation values may be determined as appropriate depending on configuration of the process cartridge 13 and the developing device 3, the range of the remaining amount of toner detection, and the like.

As described above, the accuracy of sequential toner remaining amount detection can be increased according to the present embodiment.

Fourth Embodiment

Next, the Fourth Embodiment of the present invention will be described.

Basic configuration and operation of the image forming apparatus of the present invention are the same as those of the First, the Second, and the Third Embodiments. Therefore, the same numerals and symbols are attached to the elements having substantially same as or equivalent to functions and configurations of the image forming apparatus of the First, the Second, and the Third Embodiments, accordingly detailed description will be omitted. Hereinafter, only characteristic parts to the present embodiment will be described.

<Calculation, Correction of Remaining Amount of Toner>

The characteristic of the present embodiment is to correct the calculation of the remaining amount of toner with respect to F value (reference value) in the same manner as the First Embodiment, but to make the correction at an earlier stage when the toner remaining amount is estimated to be 25% based on the band of output fluctuation, and to set the reference value at this time. In the First, the Second, and the Third Embodiments, F value was selected such that capacitance value becomes maximum (average output value becomes minimum) as the reference value. However, in the present embodiment, an average output value at a time point when the remaining amount of toner is estimated to be 25% based on the band of output fluctuation is set as a reference value. The reference value is not particularly stored before a time point when the remaining amount of toner is estimated to be 25% based by the output fluctuation value.

In the present embodiment, in the same manner as the Third Embodiment, the accuracy can be increased throughout the whole region from a region where the amount of toner is larger. It is characterized in that the accuracy can be increased, in particular, in a range where the remaining amount of toner is close to 20% to 10%.

Figure 20:
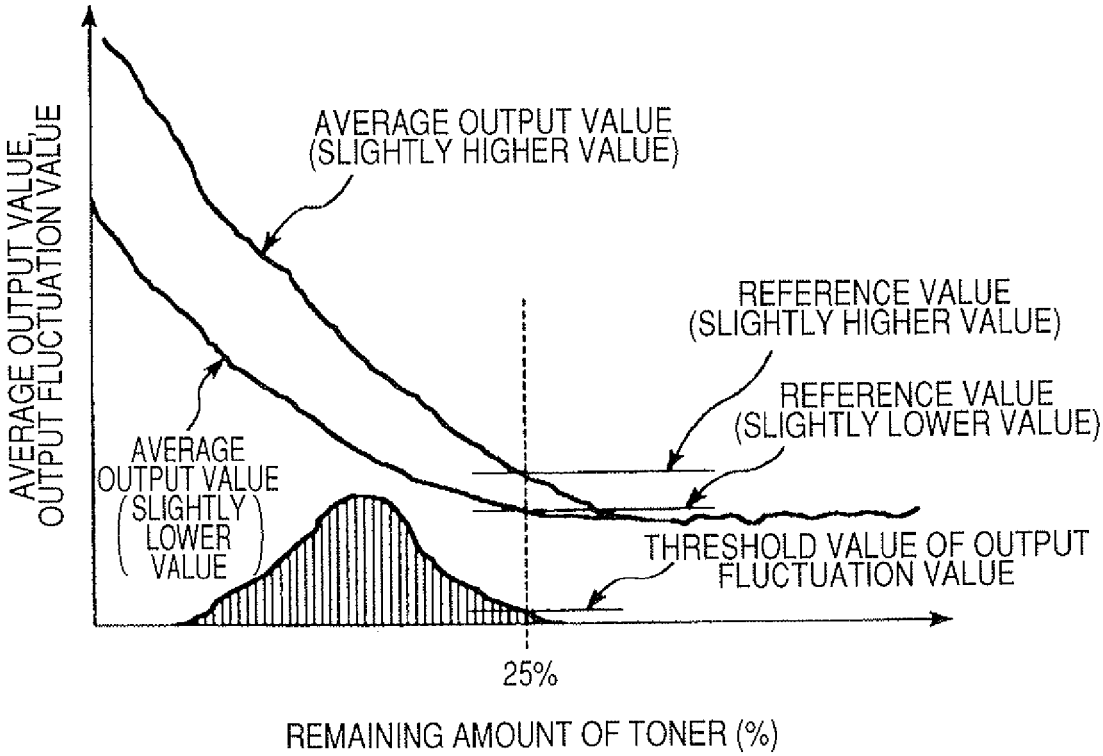
FIG. 20 is a graph illustrating a relationship between a remaining amount of toner, and an average output value, an output fluctuation value and a reference value in the fourth embodiment of the present invention.

In the present embodiment, as illustrated in FIG. 20, the average output value at a position where the output fluctuation value begins to be detected, at a time point when the remaining amount of toner is estimated to be 25% is set as a reference value. That is, the detection of the remaining amount of toner is executed taking this reference value as F value based on the toner remaining amount detecting table.

FIG. 20 illustrates a case where the average output values rise and fall resulting from individual difference of the process cartridges. In a case where the average output values are slightly low, a value at a time point when the remaining amount of toner is estimated to be 25% is taken as a reference value.

On the other hand, in a case where the average output values are slightly high, a value at a time point when the remaining amount of toner is estimated to be 25% is taken as a reference value. In respective cases, the accuracy of detecting the remaining amount of toner can be enhanced because the reference value consistent with the average output values will be set.

Whether or not the detection of the output fluctuation values has begun is dependent on whether or not the output fluctuation value has exceeded the threshold value as shown in FIG. 20. In a case where the output fluctuation value has exceeded the threshold value, it is determined that the output fluctuation value has begun to be detected, and then the reference value is set.

In the calculation of E value, as same as the First, the Second, and the Third Embodiments, the equation (2): $E=a\times F+b$ is used, where the respective constants are assumed to be $a=1.66$, $b=-0.1$. E value is calculated using the reference value as F value. The setting of the table is as shown in the Table 3.

TABLE 3

| Ratio Z of Change from F Value | Indicated Remaining Amount (%) |
|---|---|
| 0.12 | 20 |
| 0.14 | 19 |
| 0.16 | 18 |
| 0.18 | 17 |
| 0.20 | 16 |
| 0.22 | 15 |
| 0.25 | 14 |
| 0.28 | 13 |
| 0.32 | 12 |
| 0.35 | 11 |
| 0.38 | 10 |
| 0.42 | 9 |
| 0.46 | 8 |
| 0.50 | 7 |
| 0.58 | 6 |
| 0.63 | 5 |
| 0.69 | 4 |
| 0.75 | 3 |
| 0.85 | 2 |
| 1.00 | 1 |

<Correction Sequence>

Figure 21:
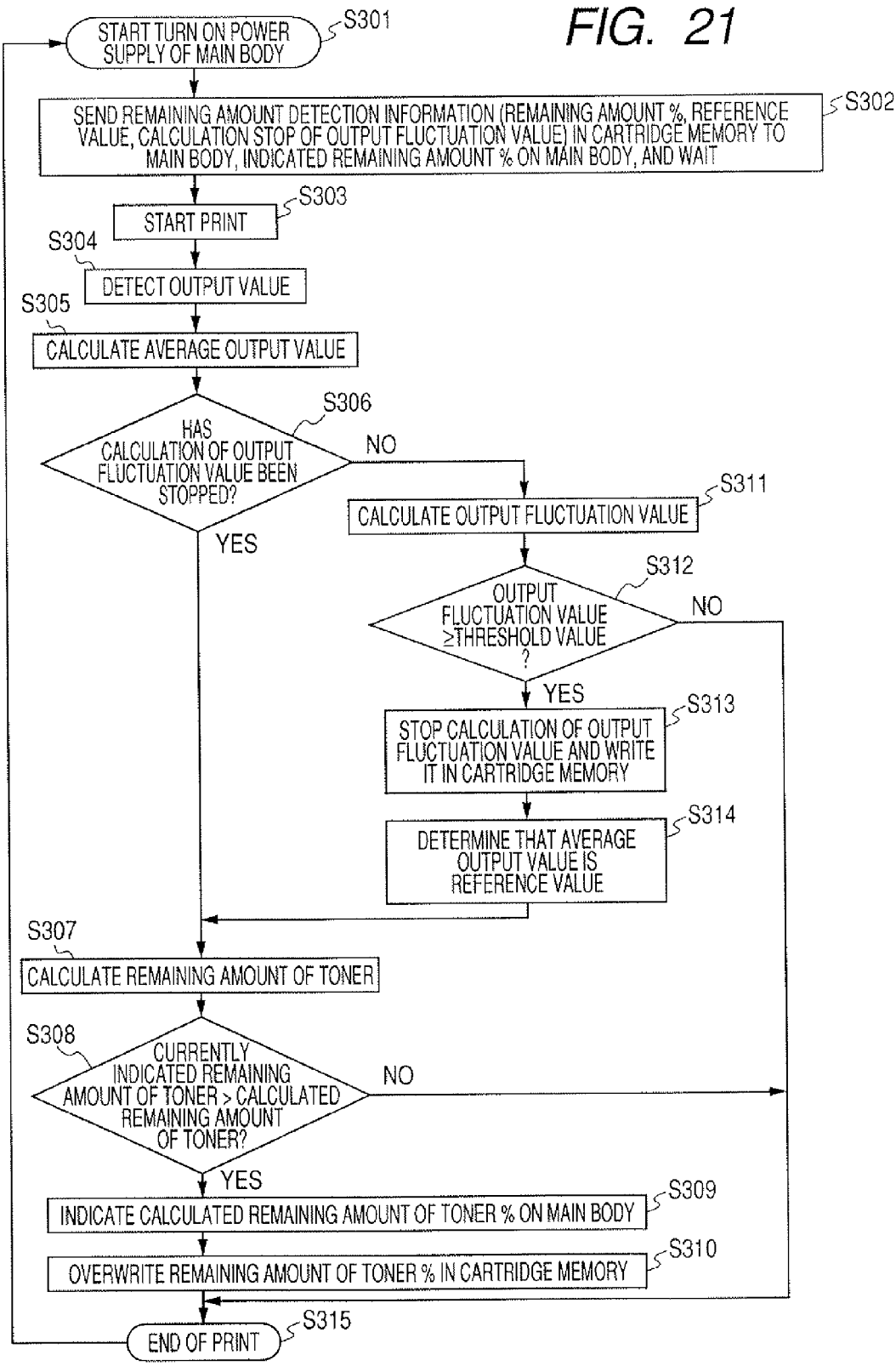
FIG. 21 is a flow chart illustrating a toner remaining amount detecting control in the fourth embodiment of the present invention.

A characteristic method of calculating the remaining amount of toner in the present embodiment will be described with reference to a flow chart in FIG. 21.

First, a toner remaining amount detecting control is started by turning the power supply on (S301).

The controlling portion 22 of the main body controller 26 reads remaining amount detection information (F value, E value, indicated remaining amount value (%), and information on whether or not the calculation of the output fluctuation values has been stopped) stored in the cartridge side memory 9, and stores the information in the main body side memory 23. At this time, the controlling portion 22 causes the remaining amount of toner to be indicated on the indicating unit 27 in a case where the indicated remaining amount value (%) has been stored, and the operation proceeds to a Wait Print state (S302).

When a printing operation starts (S303), the controlling portion 22 detects the output of the developer remaining amount detecting circuit corresponding to the remaining amount of toner as a detected value, and repeats the operation during one period of the agitating member (three seconds in the present embodiment)(S304). An average output value is calculated from among 256 values of the detected values (S305). The average output value is an average value of 256 points of the detected values as in the cases with the First, the Second, and the Third Embodiments.

Next, the controlling portion 22 determines whether or not the calculation of the output fluctuation value has been stopped (S306). Whether the calculation of the output fluctuation value has been stopped is determined, referring to the information in the main body side memory 23. In a case where the calculation of the output fluctuation value has not been stopped, the operation proceeds to S311. On the other hand, in a case where the calculation of the output fluctuation value has been stopped, the operation proceeds to S307 to calculate the remaining amount of toner using the selected table.

Next, in S308, the controlling portion 22 determines whether or not calculated remaining amount of toner is smaller than a currently indicated remaining amount of toner. In a case where the calculated remaining amount of toner is larger than the currently indicated remaining amount of toner, the printing operation ends without changing the currently indicated remaining amount of toner (S315).

On the other hand, in a case where calculated remaining amount of toner is smaller than a currently indicated remaining amount of toner, the calculated remaining amount of toner is indicated in the main body indicating unit 27 (S309). Then, a new remaining amount of toner is overwritten on the cartridge side memory 9 (S310), and the printing operation ends (S315)

In S306, the controlling portion 22, when determining that the calculation of the output fluctuation value has not been stopped, calculates the output fluctuation value from among 256 points of detected values (S311). The output fluctuation value is a difference between a maximum value and a minimum value among 256 points, as in the cases with the First, the Second, and the Third Embodiments.

Next, the controlling portion 22 determines whether or not the output fluctuation value exceeds the threshold value (S312). In a case where the output fluctuation value has not exceeded the threshold value (the amount of toner estimated from the output fluctuation value is greater than 25%), the operation proceeds to S315, and the printing operation ends.

On the other hand, in a case where the output fluctuation value has exceeded the threshold value (the amount of toner estimated from the output fluctuation value reaches 25%), the operation proceeds to S313 to stop the calculation of output fluctuation value, and to write the information on stopping the calculation of output fluctuation value in the cartridge side memory 9.

Next, the average output value is determined as a reference value (S314), and the operation proceeds to S307 to calculate the remaining amount of toner.

In the toner remaining amount detecting control according to the present embodiment, the reference value is not set before the time when the remaining amount of toner estimated based on the output fluctuation value becomes 25%, and the calculation of remaining amount of toner is not made either. At a time point when the output fluctuation value has exceeded the threshold value, it is determined that the remaining amount of toner has reached 25%. Regarding this as a trigger, and taking the average output value as a reference value, the toner remaining amount detection is performed.

As discussed above, the toner remaining amount detecting control in the present embodiment may be summarized as follows: the average output value is calculated based on detected values detected for one period of the agitating member. Also, the output fluctuation value is calculated, and the average output value at a time point when the output fluctuation value (namely, band of fluctuation) begins to be detected, that is, at a time point when estimated remaining amount of toner is 25%, is set as a reference value (=F value), and the detection of the remaining amount of toner is executed. The accuracy of sequential toner remaining amount detection as a whole can be increased, in particular, in a range where the remaining amount of toner is around 20 to 10% by using this control.

It should be noted that, in the present embodiment, the threshold value of the output fluctuation value may be determined as appropriate, depending on the configurations of the process cartridge 13 and the developing device 3, and the range of toner remaining amount detection.

As described above, according to the present embodiment, the accuracy of sequential toner remaining amount detection can be increased, in particular, in a range where the remaining amount of toner is around 20 to 10% by using this control.

Fifth Embodiment

Figure 22:
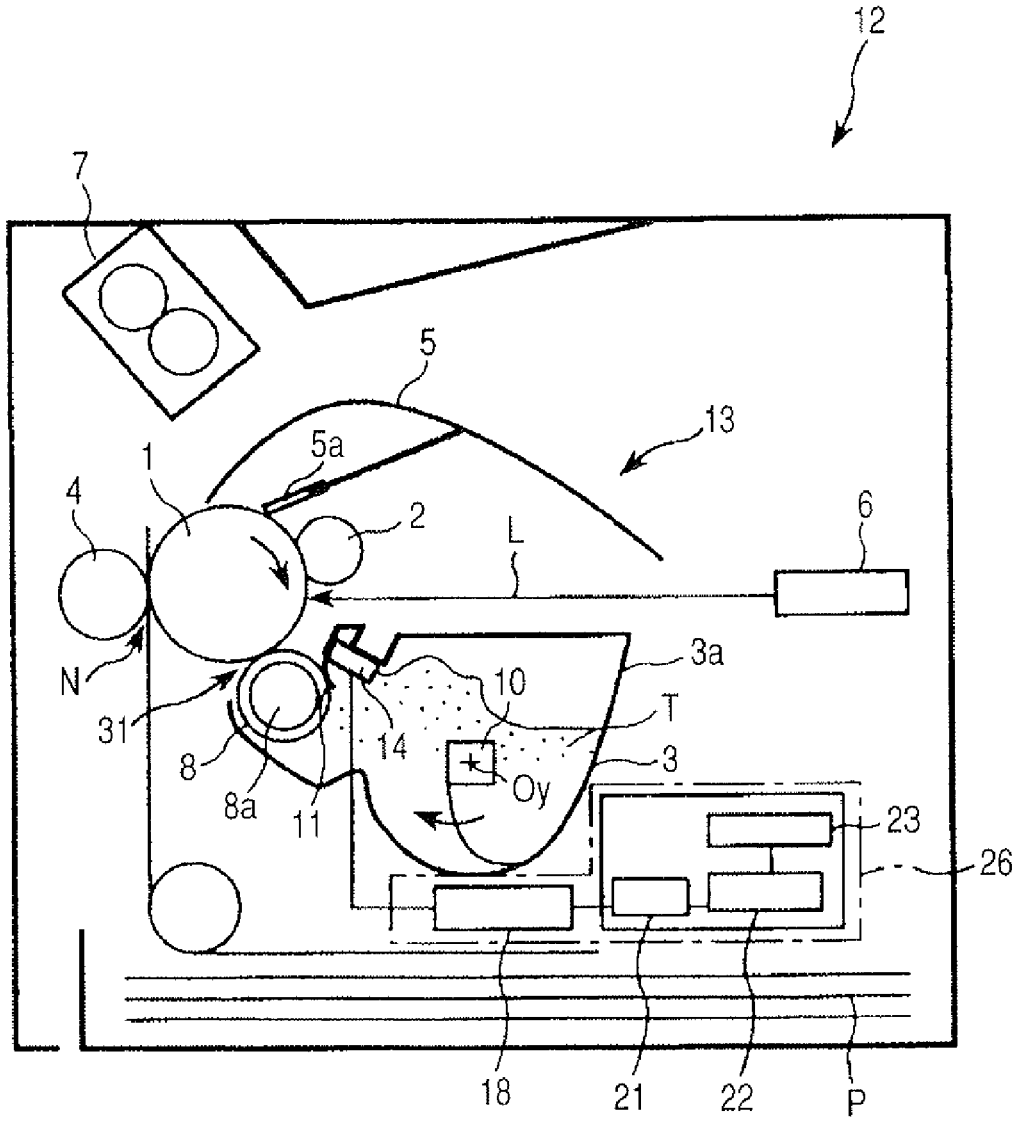
FIG. 22 is a schematic cross-sectional configuration view illustrating another embodiment of an image forming apparatus according to the present invention.

Next, the Fifth Embodiment of the present invention will be described. FIG. 22 illustrates a schematic configuration of the image forming apparatus of the present embodiment.

Basic configuration and operation of the image forming apparatus of the present invention are the same as those of the First Embodiment. Therefore, the same numerals and symbols are attached to the elements having substantially the same as or equivalent to functions and configurations of the image forming apparatus of the First Embodiment, and accordingly a detailed description of the image forming apparatus and respective components will be omitted.

FIG. 22 illustrates a schematic configuration of a laser beam printer of electrophotographic system serving as an image forming apparatus of the present invention.

An image forming apparatus 12 of the present embodiment utilizing electrophotography technology includes a drum-shaped elecrophotographic photosensitive member, namely a photosensitive drum 1 as an image bearing member. Around the photosensitive drum 1 are arranged a charging roller 2 as a charging unit, a developing device 3 as a developing unit, a transfer roller 4 as a transfer unit, a cleaning device 5 having a cleaning blade 5*a* as a cleaning unit, in this order along a rotational direction of the photosensitive drum 1. In addition, an exposure device 6 is arranged at an upper level between the charging roller 2 and the developing device 3. A fixing device 7 is arranged at the downstream side of a transfer nip N formed between the photosensitive drum 1 and the transfer roller 4 in a recording sheet conveying direction.

In the present embodiment, the photosensitive drum 1, the charging roller 2 and the developing device 3, and the cleaning device 5, among the above component members, are integrally unitized, thus forming a process cartridge 13 detachably mountable to the image forming apparatus main body.

In the present embodiment, the photosensitive drum 1 has an OPC (organic photoconductive) layer on a drum base body made of aluminum, and is driven to rotate in the direction as shown by the arrow (clockwise direction) at a predetermined circumferential speed by a driving unit (not shown) provided at the image forming apparatus main body side. The photosensitive drum 1 is uniformly charged at negative polarity by the charging roller 2 that comes into contact with the drum during the rotating process thereof.

The charging roller 2 as a charging unit causes the photosensitive drum 1 to be uniformly charged at a predetermined polarity and electric potential by a charging bias applied from a charging bias power source (not shown). As a charging bias, DC voltage Vprdc corresponding to a dark spot potential Vd on the photosensitive drum is applied so as to be superimposed on AC voltage Vpp at which the charging roller 2 is fully discharged. An alternating current AC component of the charging bias performs a constant current control such that a constant electric current flows always between the photosensitive drum 1 and the charging roller 2.

The exposure device 6 outputs from a laser output portion (not shown) image information input from a personal computer, and the like (not shown) as a laser beam (exposure beam) modulated in accordance with time-series electric digital image signal by a video controller (not shown). An exposure beam L makes scanning and exposure of the charged surface of photosensitive drum 1, thereby forming an electrostatic latent image corresponding to image information.

The developing device 3 includes a developing container 3*a* as a developer containing portion, and contains a developer T. Also, at the opening of the developing container 3*a*, a developing sleeve 8 as a developer carrying member formed at a non-magnetic developing member such as aluminum pipe that is rotatable freely keeping a predetermined interval is arranged opposite to the surface of the photosensitive drum 1.

In the present embodiment, the reduction in size of the process cartridge the image forming apparatus main body is achieved by using the developing sleeve 8 with a radius of cross-section of 6 mm.

Further, within a developing container 3*a* there are included the agitating member 10 for agitating the developer, that is rotatable in the direction as shown by the arrow, and a developing blade 11 for frictionally charging the developer on the developing sleeve 8. In the present embodiment, the developer T uses a mono-component magnetic developer (namely, toner) with a mean particle size of 7 μm. The developer is not limited to a mono-component magnetic toner.

The agitating member 10 uses a PPS sheet having a thickness of 100 μm, and makes one revolution in about ten seconds in the present embodiment. The toner is conveyed to the developing sleeve 8 by the agitating member 10. The toner T is taken in by the developing sleeve 8, and at this time, the layer thickness of the toner T is regulated by the developing blade 11, and at the same time, fed to a developing region 31 being frictionally charged. Also, the toner that has not contributed to development moves to a top of the developing blade accompanied by the rotation of the developing sleeve 8, and returns to the developing container 3*a*. The developing blade 11 is made to be elastic blade made of urethane rubber or the like, to abut on the developing sleeve 8 at a predetermined pressure, gives the toner T electric charge needed for development, and regulates the layer thickness of the toner on the developing sleeve 8.

In the developing region 31, the toner T is caused to adhere to an electrostatic latent image on the photosensitive drum 1, thus visualizing the image as a toner image. Within the developing sleeve 8, there is arranged a magnet roller 8*a* serving as a magnetic field generating unit where multiple magnetic poles N, S are formed alternately. The magnet roller 8*a* is arranged unmoveably relative to the developing sleeve 8. The magnet roller 8*a* does not perform rotational movement, but is held at a fixed position always, being kept in the same pole direction.

In the present embodiment, mone-component magnetic developer is used as a toner T, and a reverse development is performed, as described above. The developing bias with a superimposing of direct current DC on alternating current AC is applied from the developing bias power source 80 (FIG. 24) to the developing sleeve 8. The toner T conveyed to within the developing region 31 by the developing bias, flies from the developing sleeve 8 to the photosensitive drum 1. The developing bias was applied on DC voltage of Vdc=−400 V, and AC voltage of Vpp=1400 V using a rectangular wave with a frequency of 2000 Hz.

The transfer roller 4 as a transfer unit, comes into contact with the surface of the photosensitive drum 1 at a predetermined pressure force to form a transfer nip portion N, and the developing bias is applied from the developing bias power source (not shown). Toner images on the surface of the photosensitive drum 1 are transferred by the transfer bias to a recording sheet P such as paper at the transfer nip portion N situated between the photosensitive drum 1 and the transfer roller 4.

The fixing device 7 has a heating roller equipped with a halogen heater (not shown) in its interior and a pressure roller. The toner images are transferred on the surface of the recording sheet P, while conveying the recording sheet P by a fixing nip between the fixing roller and the pressure roller holding so as to be sandwiched therebetween. The transferred toner images are subjected to heating, fusing, and pressing, thus achieving thermal fixing to obtain permanent images. The permanent images that have completed the fixing on the recording sheet P are discharged to the outside of the image forming apparatus 12.

The cleaning blade 5*a* as a cleaning unit cleans the toner that remains without being transferred on the photosensitive drum 1, but the photosensitive drum 1 is made available again for use in an image formation.

The process cartridge 13 is filled with toner of 500 g in the present embodiment, and is designed to have lifetime of 10,000 sheets based on the coverage rate of 4% printing on A4-sized paper.

Hereinafter, the characteristic parts in the present embodiments will be described.

The characteristic of the present embodiment is in a configuration having a developer (toner) detecting member comprising a developer (toner) remaining amount detecting unit 17, namely, an antenna member 14 as a detecting electrode.

Also, in the present embodiment, as in the case with the First Embodiment, the antenna member is provided between the developing member and the agitating member, over a line that connects between the center of the developing member and the center of the agitating member, along a longitudinal direction of the developing member. And, the antenna member outputs a signal in response to capacitance between the developing member and the antenna member, generated by a voltage applied to the developing member.

<Description of Toner Remaining Amount Detection>

Next, a developer remaining amount detecting unit 17 utilizing a change in the capacitance values used in the present embodiment will be described with reference to FIG. 22 to FIG. 28.

In the present embodiment, a developer (toner) remaining amount detecting unit 17 has a developer (toner) remaining amount detecting member, namely, an antenna member 14 as a detecting electrode. According to the present embodiment, the antenna member 14 serves as a plate antenna metal plate (hereinafter referred to as "PA metal plate") provided over a whole region in longitudinal direction at a position opposite the developing sleeve 8. Also, the PA metal plate 14 is arranged between the developing sleeve 8 and the agitating member 10, and detects the remaining amount of toner in terms of capacitance between the developing sleeve 8 and the PA metal plate 14.

Figure 25A:
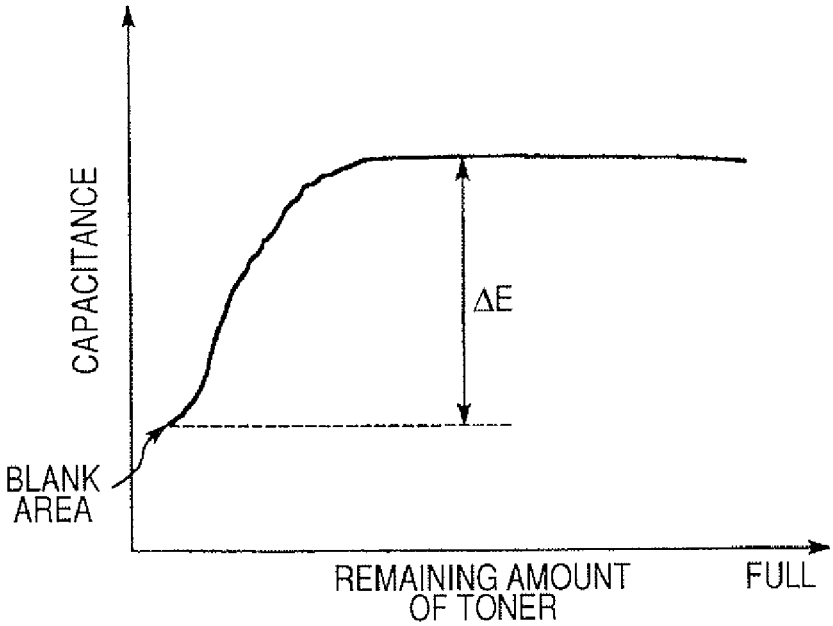
FIG. 25A is a graph illustrating a relationship between a remaining amount of toner and a capacitance value in a developer remaining amount detecting unit.

In order to detect the amount of toner with good accuracy, it is desired to have a large enough difference Δ (ΔE as shown in FIG. 25A) between capacitances measured when the toner T is sufficiently filled in the developing container 3*a*, that is, when the toner is in a full state, and when the amount of toner T is small and a satisfactory image can not be obtained (hereinafter, the state is referred to as "blank area").

Figure 25B:
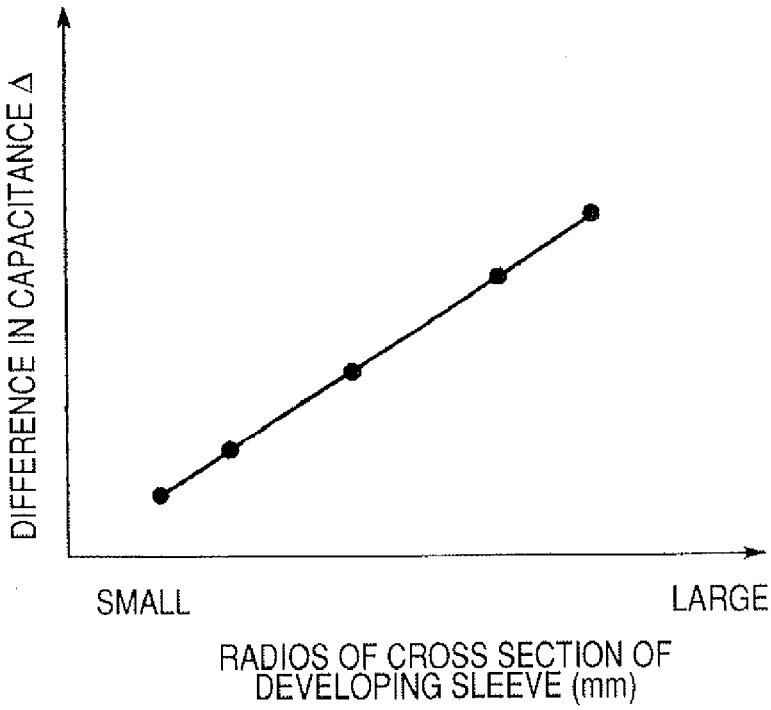
FIG. 25B is a graph illustrating a relationship between a radius of a cross-section of developing sleeve and a difference Δ in capacitance.

However, as understood in a relationship between a radius of cross-section of the developing sleeve 8 and difference in capacitance Δ, difference in capacitance Δ becomes small as the radius of cross-section of the developing sleeve 8 becomes small, as shown in FIG. 25B.

According to eager study by the inventors, difference in capacitance Δ becomes small with the developing sleeve 8 with a radius of cross-section of 6 mm used in the present embodiment, accordingly it is hard to achieve the accuracy of toner remaining amount detection.

Thus, it is characteristic, in the present embodiment too, to execute toner remaining amount detection based on a difference between a maximum value and a minimum value of capacitance values that vary periodically accompanied by the rotation of the agitating member 10, namely, the amount of change in a band of fluctuation in a predetermined time, as described in the above-mentioned embodiments.

At first, the band of fluctuation and the amount of change in capacitance values in the present embodiment will be described.

The toner state within the developing container 3*a* is changed by a rotation of the agitating member 10, and capacitance values vary periodically. This period varies at the same period as a rotating period of the agitating member 10. In the present embodiment, the rotation of the agitating member is ten seconds period, accordingly the change in capacitance is also ten seconds period.

Figure 26A:
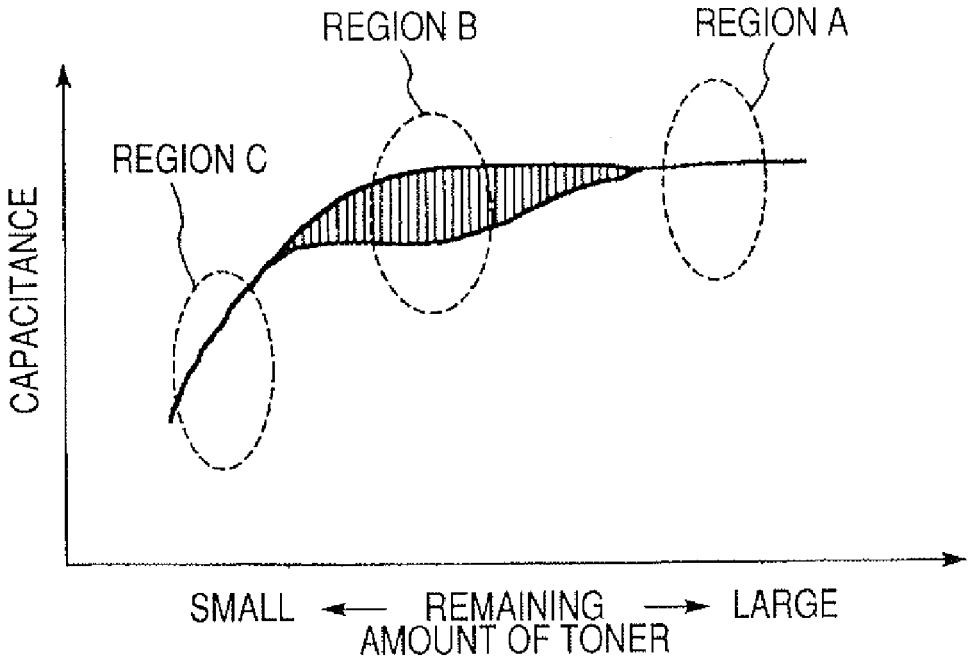
FIG. 26A and FIG. 26B are graphs illustrating a relationship between a remaining amount of toner and a deviation of detected value.
Figure 26B:
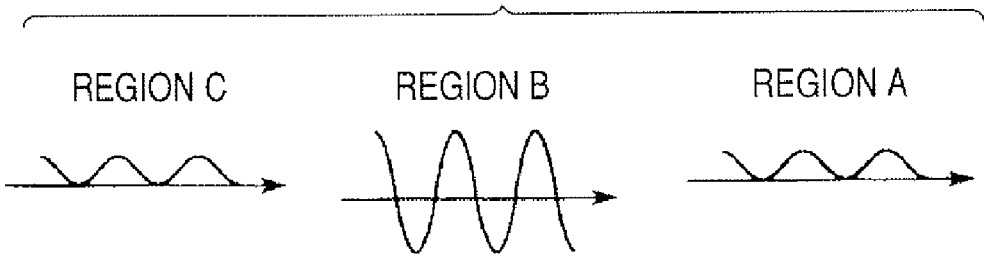
Figure 27A:
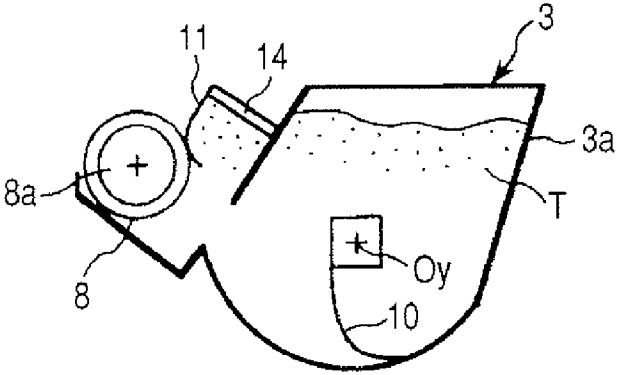
FIG. 27A, FIG. 27B, FIG. 27C and FIG. 27D are schematic cross-sectional diagrams illustrating a movement of toner and agitation within a developing device.
Figure 27B:
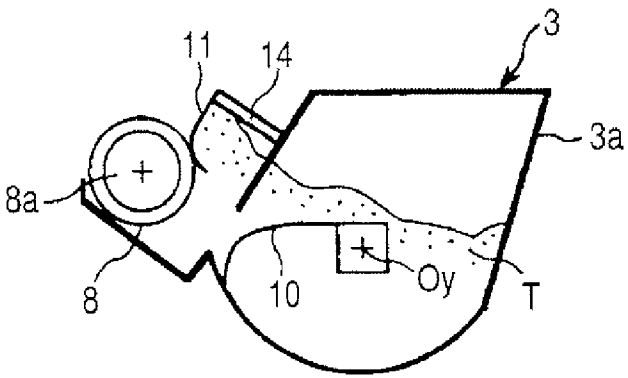
Figure 27C:
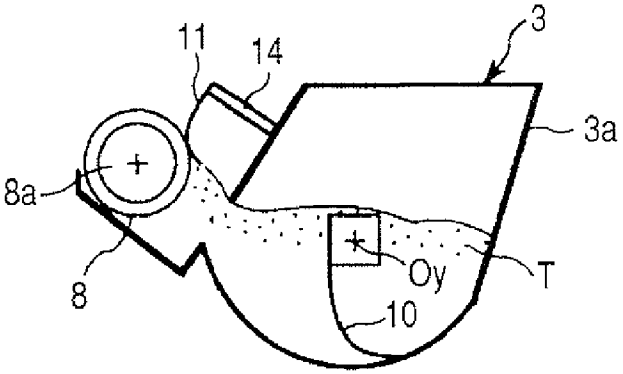
Figure 27D:
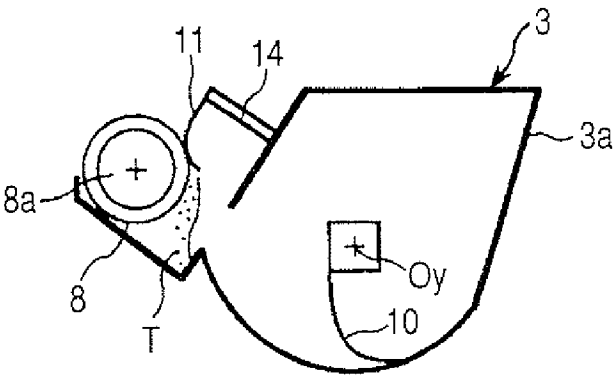

Also, as illustrated in FIG. 26A, the band of fluctuation in capacitances varies with the remaining amount of toner. This band of fluctuation progresses from a region A, a region B, to a region C with respect to the remaining amount of toner, as illustrated in FIG. 26B. This is due to the following reason:

As illustrated in FIG. 27A, the band of fluctuation is hardly detected in a region where the remaining amount of toner is large enough (the region A in FIG. 26A). However, as illustrated in FIG. 27B and FIG. 27C, a range where a space (the region B in FIG. 26A) is created between the developing sleeve 8 and the PA metal plate 14, capacitance value varies greatly at an agitating period, and a band of fluctuation becomes large. Further, as illustrated in FIG. 27D, when the amount of toner becomes small (the region C in FIG. 26A), the influence by the agitating member 10 disappears, and the band of fluctuation converges again.

Therefore, the progression of the band of fluctuation is as illustrated in FIG. 26B.

Further, the amount of toner when the band of fluctuation begins to appear, the amount of toner when the band of fluctuation becomes a maximum, and the amount of toner when the band of fluctuation converges is dependent on a positional relationship between the developing sleeve 8 and the PA metal plate 14.

As a result of verification of plural process cartridges by the inventors, a relationship between a position where the band of fluctuation begins to appear, a maximum position, a position where the band of fluctuation converges, and the amount of toner, hardly changed, keeping constant.

In the present embodiment, the PA metal plate 14 is situated between the developing sleeve 8 and the agitating member 10, and arranged over a straight line Lxy that connects between the center of rotation Ox of the developing sleeve 8 and the center of rotation Oy of the agitating member 10. This ensures that the toner goes in and out between the developing sleeve 8 and the PA metal plate 14.

Figure 23A:
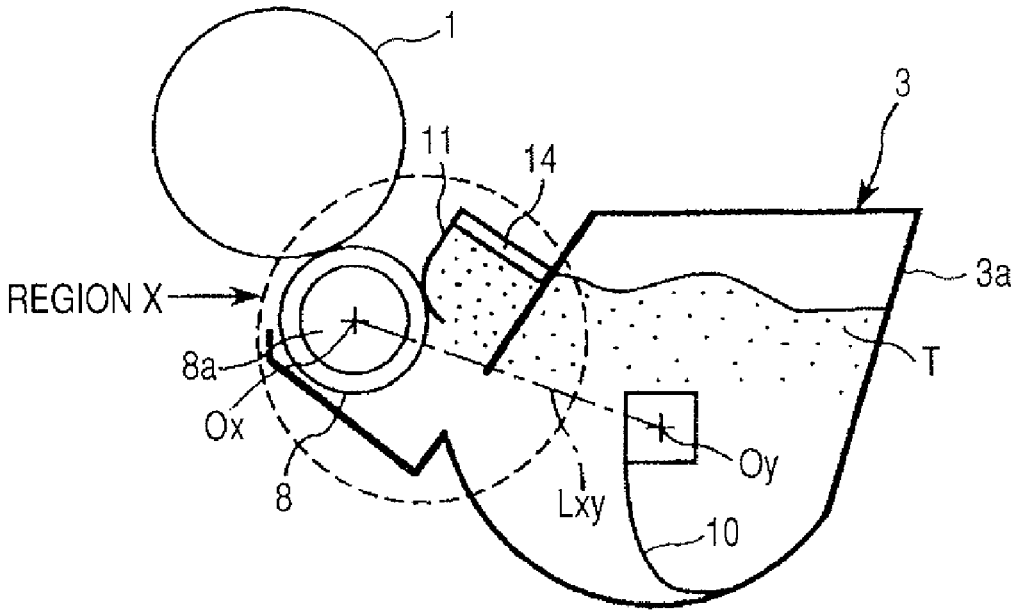
FIG. 23A and FIG. 23B are schematic cross-sectional configuration views illustrating another embodiment of a developing device to which the present invention is applicable.
Figure 23B:
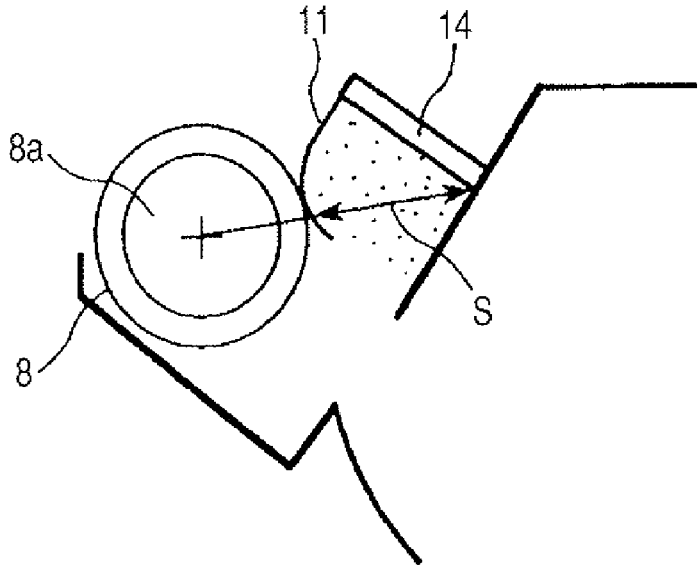

Also, as illustrated in FIG. 23B that illustrates an enlargement of a region X in FIG. 23A, in a case where a distance S1 between the surface of the developing sleeve 8 and the furthest part of the PA metal plate 14 is 15 mm or further, it is undesirable because the band of fluctuation in capacitance Δ accompanied by the rotation of the agitating member 10 becomes small for a small area of the PA metal plate 14, and the detected value of capacitance becomes unstable even for sufficiently large area of the PA metal plate 14. On the other hand, when the furthest part S is closer than 3 mm, there arises a possibility that blank area images are generated before capacitance begins to change.

Accordingly, from viewpoint of obtaining the accuracy of toner remaining amount detection, it is desirable that the PA metal plate 14 is arranged vertically higher than the center of rotation Oy of the agitating member 10, and the furthest part S in terms of a distance from the surface of the developing sleeve 8 is 3 mm≦S≦15 mm.

Hence, in the present embodiment, it was designed that, letting a distance S, S=12 mm, the amount of change becomes 0 (zero), when the remaining amount of toner is 20%.

Also, for the antenna member 14, the band of fluctuation in capacitance Δ can be made larger than a case where a bar-like antenna member was selected by selecting a plate-shaped member like the above-mentioned PA metal plate. In particular, it is advantageous in a developing device using the developing sleeve 8 with a small radius cross-section as in the present embodiment.

Any material of the antenna member 14, if it is a material through which an electric current can flow can be used without the need for specifically limited ones. In the present embodiment, SUS plate (SUS 316-CP) is used as a material of the PA metal plate serving as the antenna member 14.

<Description of Toner Remaining Amount Detecting Circuit>

Next, one example of the developer (toner) remaining amount detecting unit 17 used in the present embodiment will be described. Also in the present embodiment, the configuration of the toner remaining amount detecting unit 17 is made to be the same as that of the First Embodiment as illustrated in FIG. 4.

Figure 24:
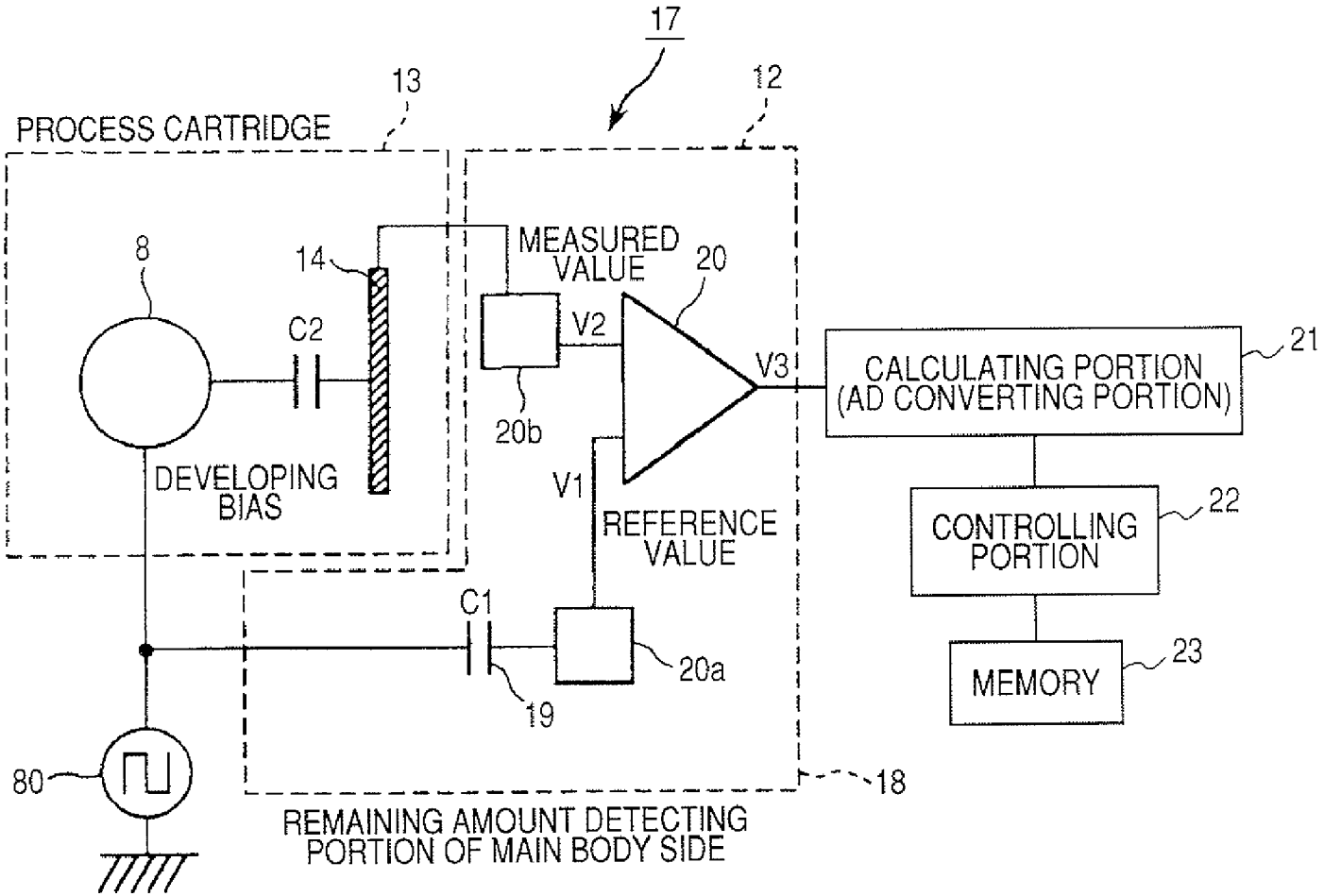
FIG. 24 is a block diagram illustrating another embodiment of a developer remaining amount detecting circuit.
Figure 28:
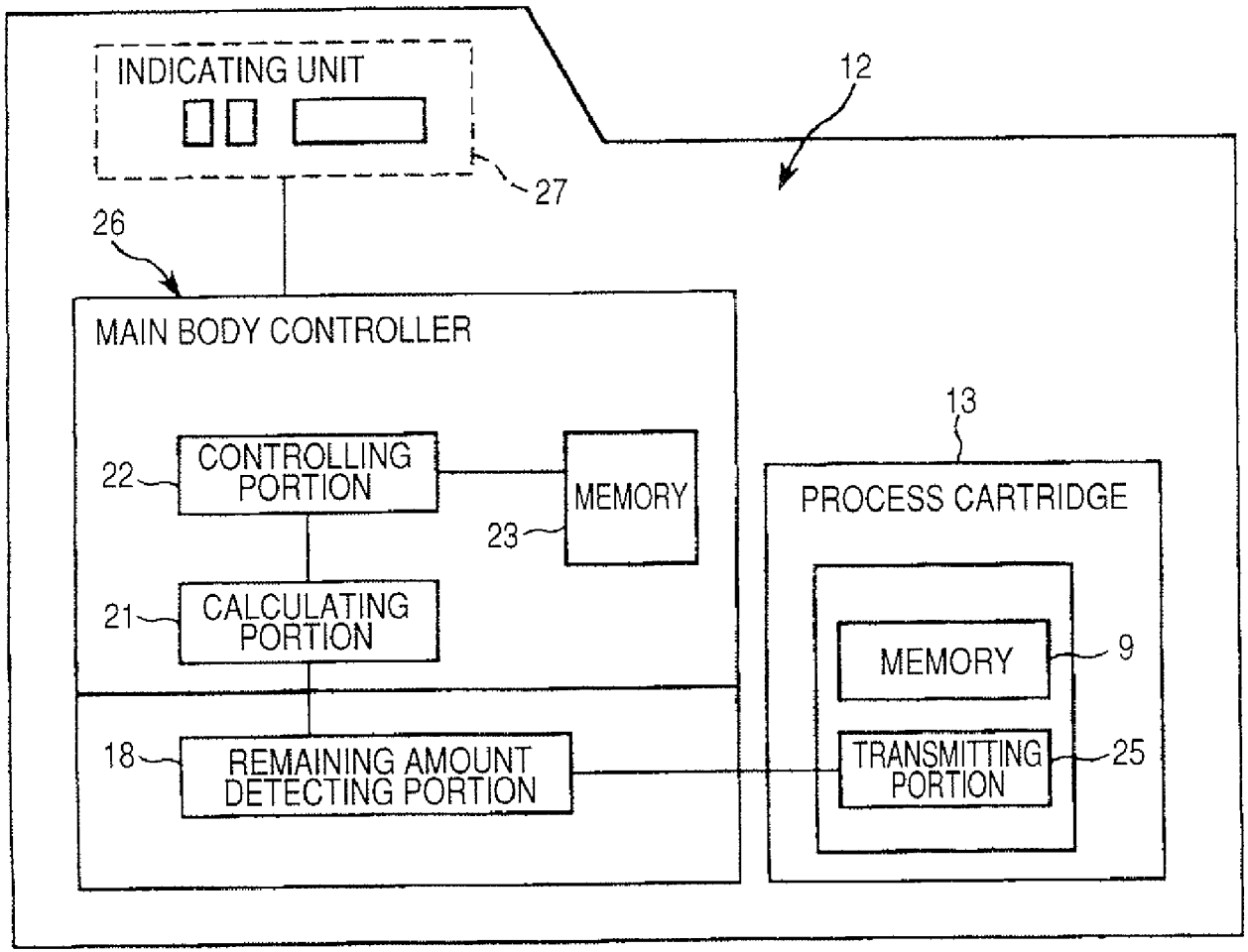
FIG. 28 is a block diagram of a main body controller.

In other words, FIG. 24 illustrates a configuration of the toner remaining amount detecting circuit comprising the toner remaining amount detecting unit 17 for detecting the amount of toner within the process cartridge. As illustrated in FIG. 28, a main body side remaining amount detecting portion 18 comprising the toner remaining amount detecting circuit of the toner remaining amount detecting unit 17 is provided in the apparatus main body. And, voltage values determined based on capacitances between the antenna members, namely, the PA metal plate 14 and the developing sleeve 8 are output.

To describe further, the image forming apparatus 12 and the process cartridge 13 are provided with electrical contacts (not shown). And, when the process cartridge 13 is attached to the image forming apparatus 12, electrical connection between the PA metal plate 14 and the remaining amount detecting portion 18 in the image forming apparatus 12 is established through the electrical contacts.

As understood referring to FIG. 28, the main body controller 26 includes the remaining amount detecting portion 18, the calculating portion 21, the controlling portion 22, and the main body side memory 23, as in the case with the First Embodiment. The main body controller 26 constitutes a controlling unit for calculating the remaining amount of toner estimated from detected values that have been detected at the cartridge side 13.

In FIG. 24, a predetermined AC bias is output from a developing bias power source 80 as a developing bias applying unit. The applying bias is applied to a capacitor 19 for reference (capacitor C1; fixed value), the developing sleeve 8, respectively. Thereby, a voltage V1 is generated across the both ends of the capacitor 19 for reference. And, a voltage V2 is generated to the capacitance (capacitance C2; variable depending on the remaining amount of toner) between the developing sleeve 8 and the PA metal plates 14.

A detecting circuit 20 creates a voltage V3 that is a measured value from a voltage difference between the voltages V1, V2, and outputs the resulting voltage V3 to an AD converting portion 21. The AD converting portion 21 outputs the results of digital-conversion of analog voltage V3 to the controlling portion 22. The controlling portion 22 calculates the amount of developer within the process cartridge predicted from voltage values V converted to this digital value (Unit: V). Since the developing bias is used for measurements, the measurement of the remaining amount of toner is also performed concurrent with a developing process.

As described above, detected values detected by the toner remaining amount detection portion 18 are converted to voltages at the controlling portion 22 of the image forming apparatus main body, and are output. In the present embodiment, it is so conFIGured that the smaller a remaining amount of toner becomes (the smaller a capacitance C4 becomes), the larger a detected value becomes. The image forming apparatus 12 detects its remaining amount sequentially in response to the consumption of toner T within a developing container 31 with the help of the remaining amount detecting unit 17.

According to the system of the present embodiment, as in the case with the First Embodiment, a toner near-end system is adopted, in which detected values do not change greatly up to the region A in FIG. 26A, whilst sequential remaining amount detection can be executed from a time point when the remaining amount of toner has decreased down to a certain small level, namely, from the region B As described above, in the present embodiment, a superimposed bias of an alternating current bias of 1400 Vpp, 2000 Hz, serving as a developing bias, and a direct current bias of −400 V are applied to the developing sleeve 8. Then, an AC current flows between the developing sleeve 8 and the antenna member 14 opposed thereto, and the electric current values are measured with electric current measuring devices 20*a*, 20*b*, further converted to voltage values (V1, V2).

Thus, voltage values serving as remaining amount signals based on capacitances between the developing sleeve 8 and the antenna member 14 are detected from electric current values measured with the electric current measuring devices 20*a*, 20*b*.

In other words, the PA metal plate serving as the antenna member 14 is arranged in the developing device, and a user is able to know the amount of toner within the developing container 3*a* by measuring capacitances between the developing sleeve 8 and the antenna member 14.

In the present embodiment too, a method of detecting the remaining amount of developer that is the same as described in the First, the Second, the Third, and the Fourth Embodiments, and the accuracy of sequential detection of the remaining amount of toner can be increased.

Other Embodiments

Averaging sections of detected values, respective threshold values of the output fluctuation values, toner remaining amount detecting tables, various predetermined values as described in the First to Fifth Embodiments vary depending on the configuration of the image forming apparatus, and the process cartridge, and thus there is a need to change according to respective configurations.

In the above-mentioned First to Fifth Embodiments, it is described that a toner remaining amount detecting table 24 is stored in the main body controller 26, but may be stored in the cartridge side memory 9. In this case, it is possible to cause the table adapted to the characteristics of respective process cartridges to be retained in the process cartridge 13 per se to use, and thus more accurate toner remaining amount detection can be made.

In the above-mentioned First to Fifth Embodiments, it is described that increasing and decreasing relationship between capacitance values detected by the developer remaining amount detecting unit and detected values the developer remaining amount detecting portion 18 is set to be reversed (as capacitance value decreases, detected value increases). However, this relationship is various depending on circuits provided in the image forming apparatus, and either decreasing function or increasing function with the same relationship between capacitance and voltage will be justified.

In the above-mentioned First to Fifth Embodiments, a plate metal plate system is used as a detecting unit for the remaining amount of toner, but more developer remaining amount detecting members may be provided to increase the detecting accuracy of the remaining amount of toner.

In addition, the toner remaining amount detection in the above-mentioned First to Fifth Embodiments is a toner near-end system in which sequential remaining amount detection can be executed from the time point forward when the remaining amount of toner becomes small. However, other developer remaining amount detecting units may be combined to execute the toner remaining amount detection from the time point when much more toner amount remains. For example, the remaining amount of toner may be detected sequentially from the time point when the amount of toner is larger by providing the electrode members in the bottom of the developing device too. To sequentially detect the remaining amount of developer includes not only sequentially detecting in all regions from the state where the remaining amount of developer is 100% to the state of 0%, but also sequentially detecting from the state where the remaining amount of the developer decreases, for example, down to 50%, and 15%. Also, the remaining amount of the develop of 0% does not mean only that the developer within the developing device has been totally consumed, but, for example, includes a state where the amount of developer predetermined in advance still remains. The amount of developer predetermined in advance constitutes, for example, the remaining amount of developer at which it is difficult to form images with a predetermined quality.

As a developer remaining amount detecting unit, the unit of capacitance detection system, as described in the above-mentioned First to Fifth Embodiments, is suitable from the viewpoints of satisfactory detecting accuracy, relatively simple circuit configuration thereof. But the invention is not limited to this. There are other systems capable of sequentially issuing a signal in response to the amount of developer within the developer containing portion, and capable of obtaining the remaining amount of developer depending on the amount of change in detected output values from an output reference value corresponding to the maximum amount of developer. Even in a case where other systems are used, the invention is applicable in the same manner. A combination of developer remaining amount detecting units of plural systems may be used.

In respective embodiments as above-mentioned, it is described that a cartridge detachably mountable to the apparatus main body is a process cartridge 13 that combines integrally the photosensitive drum 1, the charging roller 2, the developing device 3, and the cleaning device 5 as a cartridge system. But the present invention is not limited to this. The process cartridge includes one that combines integrally the photosensitive member, and at least either one of the charging unit, the developing unit, and the cleaning unit serving as a process unit that acts on the photosensitive member as a cartridge system, and is detachably mountable to the apparatus main body.

Also, even in a case where the developing device (developing cartridge) is made to be detachably mountable alone to the apparatus main body, as a cartridge detachably mountable to the apparatus main body, the invention is equally applicable. In this case, the configuration of the developing cartridge is equivalent to the one that the photosensitive drum 1, the charging roller 2, the cleaning device 5 are removed from the process cartridge 13 in the respective embodiments as above-mentioned. It may be considered that the cartridge side memory 9 is provided in the developing cartridge.

Further, even in a case where the developing device is detachably mountable alone, as a cartridge detachably mountable to the image forming apparatus main body, the present invention is equally applicable. In other words, the cartridge is acceptable if a developer containing portion and a developer remaining amount detecting unit that is capable of outputting sequentially a signal in response to the amount of developer within the developer containing portion, and a storage medium are detachably mountable in one piece to the image forming apparatus main body.

In the above-mentioned First to Fifth Embodiments, it is described that the image forming apparatus forms a single color images, but the present invention is not limited to this. Even in the image forming apparatus having plural developing units, forming plural colors images (e.g. two-color images, three-color images, or full-color), the present invention is equally applicable. In this case, the toner remaining amount detecting control may be applied in such a manner as in the above-mentioned First to Fourth Embodiments to respective developer containing portion that contain developers to be used for respective developing units.

As a developing method, not only a jumping development using mono-component magnetic developer in the above-mentioned First to Fifth Embodiments, but also two-components magnetic brush developing process in the public domain and a variety of developing methods can be used.

Further, in the above-mentioned First to Fifth Embodiments, a laser beam printer is illustrated as the image forming apparatus, but the present invention is not limited to this. The present invention is applicable to a copying machine, a facsimile apparatus, or a word processor, and other image forming apparatuses using cartridges detachably mountable to the apparatus main body such as the process cartridge or the developing cartridge.

As described above, according to the First to Fifth Embodiments of the present invention, two values of the average output value and the output fluctuation value are calculated from the detected values detected by the toner remaining amount detection. And, the accuracy of toner remaining amount detection can be increased by correcting the calculation of remaining amount of toner based on a difference between average output value and ideal value at a time point when the output fluctuation value has reached a predetermined value, that is, at a time point a predetermined amount of toner is reached.

For both detected values and average output value that has subjected to averaging processing thereof, their values often rise and fall due to the factors such as use environment of the image forming apparatus main body, use condition of toner, and a small amount of toner adhering to the PA metal plate.

In a normal toner remaining amount detection, detected values and an average output value corresponding to capacitance values when the remaining amount of toner was detected as a maximum are taken as reference values. The remaining amount of toner is calculated based on a relationship (ideal value) between the average output value and the remaining amount of toner calculated from both the reference values and the toner remaining amount detecting tables. But, if the detected values and the average output value have risen and fallen, the accuracy of calculated remaining amounts of toner may become worse.

However, a band of output fluctuation is detected by agitating toner with the agitating member, and calculated according to the remaining amount of toner. A relationship between the output fluctuation value and the remaining amount of toner hardly changes. In particular, a position where the output fluctuation value begins to be detected, a peak position, a position where fluctuation converges, are brought into correspondence with a relationship with the remaining amount of toner with good accuracy. However, since the value of the band of output fluctuation per se cannot be taken large, it is difficult to sequentially detect the remaining amount of toner only from the band of output fluctuation.

Hence, in the present invention, the accuracy can be increased while sequentially detecting the remaining amount of toner by correcting the toner remaining amount detection based on the output fluctuation value via the average output value. The output fluctuation value is calculated from normal detected values, the accuracy of toner remaining amount detection can be enhanced without the need for additional members and devices.

According to the present invention, the accuracy of detecting the remaining amount of developer within the developer containing portion of the developing device can be enhanced.

This application claims the benefit of Japanese Patent Application No. 2006-055610, filed Mar. 1, 2006, which is hereby incorporated by reference herein in its entirety.

What is claimed is:

1. An image forming apparatus, which uses a developing device including: a developer carrying member developing an electrostatic latent image formed on an electrophotographic photosensitive member with a developer; a developer containing portion containing the developer; an agitating member provided rotatably in the developer containing portion to agitate the developer; and a developer remaining amount detecting member outputting a signal for detecting a remaining amount of the developer contained in the developer containing portion, the image forming apparatus comprising:

a main body controller to which the signal is input, and which detects the remaining amount by using a first detecting unit that sets a reference value serving as a reference for detecting the remaining amount by the signal, and thereafter calculates the remaining amount based on an amount of change in the signal from the reference value, and a second detecting unit that detects the remaining amount based on a band of fluctuation in the signal corresponding to a rotational period of the agitating member.

2. An image forming apparatus according to claim 1, wherein the reference value is set in a state in that the developer containing portion contains a full amount of the developer.

3. An image forming apparatus according to claim 1, further comprising an indicating unit that indicates the remaining amount of the developer detected by the main body controller.

4. An image forming apparatus according to claim 1, wherein the developer remaining amount detecting member has includes:

a first electrode that is provided along a longitudinal direction of the developer carrying member, above a line connecting between a center of the developer carrying member and a center of the agitating member, and between the developer carrying member and the agitating member, the first electrode outputting a signal corresponding to a capacitance between the developer carrying member and the first electrode, the capacitance being generated by a voltage applied to the developer carrying member.

5. An image forming apparatus according to claim 1, wherein the developer remaining amount detecting member includes:

a first electrode that is provided along a longitudinal direction of the developer carrying member, above a line connecting between a center of the developer carrying member and a center of the agitating member, and between the developer carrying member and the agitating member, the first electrode outputting a signal corresponding to a capacitance between the developer carrying member and the first electrode, the capacitance being generated by a voltage applied to the developer carrying member; and a second electrode that is provided along a longitudinal direction of the first electrode, above the line connecting between the center of the developer carrying member and the center of the agitating member, and between the developer carrying member and the agitating member, the first electrode outputting a signal based on the capacitance generated between the developer carrying member and the first electrode and a capacitance generated between the first electrode and the second electrode by a voltage applied to the developer carrying member and the second electrode.

6. An image forming apparatus according to claim 1, wherein the developing device is detachably mountable to a main body of the image forming apparatus.

7. An image forming apparatus according to claim 6, wherein the electrophotographic photosensitive member and the developing device are integrally made into a process cartridge, the process cartridge being detachably mountable to the main body of the image forming apparatus.

8. An image forming apparatus, which uses a developing device including: a developer carrying member developing an electrostatic latent image formed on an electrophotographic photosensitive member with a developer; a developer containing portion containing the developer; an agitating member provided rotatably in the developer containing portion to agitate the developer; and a developer remaining amount detecting member outputting a signal for detecting a remaining amount of the developer contained in the developer containing portion, the image forming apparatus comprising:

a main body controller to which the signal is input, and which detects the remaining amount of the developer; the main body controller including: a reference value setting unit that sets a reference value serving as a reference for detecting a remaining amount of the developer using the signal; a remaining amount detecting unit that calculates a remaining amount of the developer based on an amount of change in the signal from the reference value; a band of fluctuation detecting unit that detects a band of fluctuation in the signal corresponding to a rotational period of the agitating member; and a reference value changing unit that changes the reference value to a new reference value derived from the band of fluctuation.

9. An image forming apparatus according to claim 8, wherein the reference value changing unit changes the reference value to the new reference value, when the band of fluctuation in the signal reaches a predetermined value.

10. An image forming apparatus according to claim 9, wherein a time point when the band of fluctuation in the signal reaches the predetermined value is:

(1) a time point when the band of fluctuation in the signal begins to be detected; or (2) a time point when the band of fluctuation in the signal reaches a peak value; or (3) a time point when the band of fluctuation in the signal has converged after the band of fluctuation in the signal has reached the peak value once.

11. An image forming apparatus according to claim 8, wherein the reference value is set in a state in that the developer containing portion contains a full amount of the developer.

12. An image forming apparatus according to claim 8, further comprising an indicating unit that indicates the remaining amount of the developer detected by the main body controller.

13. An image forming apparatus according to claim 8, wherein the developer remaining amount detecting member includes:

a first electrode that is provided along a longitudinal direction of the developer carrying member, above a line connecting between a center of the developer carrying member and a center of the agitating member, and between the developer carrying member and the agitating member, the first electrode outputting a signal corresponding to a capacitance between the developer carrying member and the first electrode, the capacitance being generated by a voltage applied to the developer carrying member.

14. An image forming apparatus according to claim 8, wherein the developer remaining amount detecting member includes:

a first electrode that is provided along a longitudinal direction of the developer carrying member, above a line connecting between a center of the developer carrying member and a center of the agitating member, and between the developer carrying member and the agitating member, the first electrode outputting a signal corresponding to a capacitance between the developer carrying member and the first electrode, the capacitance being generated by a voltage applied to the developer carrying member; and a second electrode that is provided along a longitudinal direction of the first electrode, above the line connecting between the center of the developer carrying member and the center of the agitating member, and between the developer carrying member and the agitating member, the first electrode outputting a signal based on the capacitance generated between the developer carrying member and the first electrode and a capacitance generated between the first electrode and the second electrode by a voltage applied to the developer carrying member and the second electrode.

15. An image forming apparatus according to claim 8, wherein the developing device is detachably mountable to a main body of the image forming apparatus.

16. An image forming apparatus according to claim 15, wherein the electrophotographic photosensitive member and the developing device are integrally made into a process cartridge, the process cartridge being detachably mountable to the main body of the image forming apparatus.

17. An image forming apparatus, which uses a developing device including: a developer carrying member developing an electrostatic latent image formed on an electrophotographic photosensitive member with a developer; a developer containing portion containing the developer; an agitating member provided rotatably in the developer containing portion to agitate the developer; and a developer remaining amount detecting member outputting a signal for detecting a remaining amount of the developer contained in the developer containing portion, the image forming apparatus comprising:

a main body controller to which the signal is input, and which detects the remaining amount of the developer, the main body controller including: a reference value setting unit that sets a reference value serving as a reference for detecting the remaining amount of the developer using the signal; a remaining amount detecting unit that calculates a remaining amount of the developer based on an amount of change in the signal from the reference value; a band of fluctuation detecting unit that detects a band of fluctuation in the signal corresponding to a rotational period of the agitating member; and a correcting unit that corrects the remaining amount of the developer calculated by the remaining amount detecting unit based on a corrected value derived from the band of fluctuation.

18. An image forming apparatus according to claim 17, wherein the corrected value is a difference between a remaining amount of the developer derived from the band of fluctuation and a remaining amount of the developer calculated in the remaining amount detecting unit, when the band of fluctuation in the signal reaches a predetermined value.

19. An image forming apparatus according to claim 18, wherein a time point when the band of fluctuation in the signal reaches the predetermined value is:

(1) a time point when the band of fluctuation in the signal begins to be detected; or (2) a time point when the band of fluctuation in the signal reaches a peak value; or (3) a time point when the band of fluctuation in the signal has converged after the band of fluctuation in the signal has reached the peak value once.

20. An image forming apparatus according to claim 17, wherein the reference value is set in a state in that the developer containing portion contains a full amount of the developer.

21. An image forming apparatus according to claim 17, further comprising an indicating unit that indicates the remaining amount of the developer detected by the main body controller.

22. An image forming apparatus according to claim 17, wherein the developer remaining amount detecting member includes:

a first electrode that is provided along a longitudinal direction of the developer carrying member, above a line connecting between a center of the developer carrying member and a center of the agitating member, and between the developer carrying member and the agitating member, the first electrode outputting a signal corresponding to a capacitance between the developer carrying member and the first electrode, the capacitance being generated by a voltage applied to the developer carrying member.

23. An image forming apparatus according to claim 17, wherein the developer remaining amount detecting member includes:

a first electrode that is provided along a longitudinal direction of the developer carrying member, above a line connecting between a center of the developer carrying member and a center of the agitating member, and between the developer carrying member and the agitating member, the first electrode outputting a signal corresponding to a capacitance between the developer carrying member and the first electrode, the capacitance being generated by a voltage applied to the developer carrying member; and a second electrode that is provided along a longitudinal direction of the first electrode, above the line connecting between the center of the developer carrying member and the center of the agitating member, and between the developer carrying member and the agitating member, the first electrode outputting a signal based on the capacitance generated between the developer carrying member and the first electrode and a capacitance generated between the first electrode and the second electrode by a voltage applied to the developer carrying member and the second electrode.

24. An image forming apparatus according to claim 17, wherein the developing device is detachably mountable to a main body of the image forming apparatus.

25. An image forming apparatus according to claim 24, wherein the electrophotographic photosensitive member and the developing device are integrally made into a process cartridge, the process cartridge being detachably mountable to the main body of the image forming apparatus.

26. A detecting method of detecting a remaining amount of a developer contained in a developer containing portion in an image forming apparatus, which uses a developing device including: a developer carrying member developing an electrostatic latent image formed on an electrophotographic photosensitive member with a developer; the developer containing portion containing the developer; an agitating member provided rotatably in the developer containing portion to agitate the developer; and a developer remaining amount detecting member outputting a signal for detecting the remaining amount of the developer contained in the developer containing portion, the detecting method comprising:

a first step of setting a reference value serving as a reference for detecting the remaining amount by the signal, and thereafter calculating the remaining amount based on an amount of change in the signal from the reference value; and a second step of detecting the remaining amount based on a band of fluctuation in the signal corresponding to a rotational period of the agitating member.

27. A detecting method according to claim 26, wherein the reference value is set in a state in that the developer containing portion contains a full amount of the developer.

28. A detecting method according to claim 26, further comprising an indicating step of indicating the remaining amount of the developer by an indicating unit provided on the image forming apparatus.

29. A detecting method of detecting a remaining amount of a developer contained in a developer containing portion in an image forming apparatus, which uses a developing device including: a developer carrying member developing an electrostatic latent image formed on an electrophotographic photosensitive member with the developer; the developer containing portion containing the developer; an agitating member provided rotatably in the developer containing portion to agitate the developer; and a developer remaining amount detecting member outputting a signal for detecting a remaining amount of the developer contained in the developer containing portion, the detecting method comprising:

a reference value setting step of setting a reference value to be a reference for detecting the remaining amount of the developer by the signal;

a remaining amount detecting step of calculating the remaining amount of the developer based on an amount of change in the signal from the reference value;

a band of fluctuation detecting step of detecting a band of fluctuation in the signal corresponding to a rotational period of the agitating member; and a reference value changing step of changing the reference value to a new reference value derived from the band of fluctuation.

30. A detecting method according to claim 29, wherein, in the reference value changing step, the reference value is changed to the new reference value when the band of fluctuation in the signal reaches a predetermined value.

31. A detecting method according to claim 30, wherein a time point when the band of fluctuation in the signal reaches the predetermined value is:

(1) a time point when the band of fluctuation in the signal begins to be detected; or (2) a time point when the band of fluctuation in the signal reaches a peak value; or (3) a time point when the band of fluctuation in the signal has converged after the band of fluctuation in the signal has reached the peak value once.

32. A detecting method according to claim 29, wherein the reference value is set in a state in that the developer containing portion contains a full amount of the developer.

33. A detecting method according to claim 29, further comprising an indicating step of indicating the remaining amount of the developer by an indicating unit provided on the image forming apparatus.

34. A detecting method of detecting a remaining amount of a developer contained in a developer containing portion in an image forming apparatus, which uses a developing device including: a developer carrying member developing an electrostatic latent image formed on an electrophotographic photosensitive member with the developer; a developer containing portion containing the developer; an agitating member provided rotatably in the developer containing portion to agitate the developer; and a developer remaining amount detecting member outputting a signal for detecting the remaining amount of the developer contained in the developer containing portion, the detecting method comprising:

a reference value setting step of setting a reference value to be a reference for detecting the remaining amount of the developer by the signal;

a remaining amount detecting step of calculating the remaining amount of the developer based on an amount of change in the signal from the reference value;

a band of fluctuation detecting step of detecting a band of fluctuation in the signal corresponding to a rotational period of the agitating member; and a correction step of correcting the remaining amount of the developer calculated by the remaining amount detecting step based on a corrected value derived from the band of fluctuation.

35. A detecting method according to claim 34, wherein the corrected value is a difference between a remaining amount of a developer derived from the band of fluctuation and a remaining amount of the developer calculated in the second step, when the band of fluctuation in the signal reaches a predetermined value.

36. A detecting method according to claim 35, wherein a time point when the band of fluctuation in the signal reaches the predetermined value is:

(1) a time point when the band of fluctuation in the signal begins to be detected; or (2) a time point when the band of fluctuation in the signal reaches a peak value; or (3) a time point when the band of fluctuation in the signal has converged after the band of fluctuation in the signal has reached the peak value once.

37. A detecting method according to claim 34, wherein the reference value is set in a state in that the developer containing portion contains a full amount of the developer.

38. A detecting method according to claim 34, further comprising an indicating step of indicating the remaining amount of the developer by an indicating unit provided on the image forming apparatus.

* * * * *